US012779353B2

(12) United States Patent
Payne et al.

(10) Patent No.: US 12,779,353 B2
(45) **Date of Patent: *Nov. 3, 2026**

(54) TOY VEHICLE WITH MOVABLE WHEEL SUPPORTS

(71) Applicant: Mattel, Inc., El Segundo, CA (US)

(72) Inventors: Julian Richard Payne, Los Angeles, CA (US); Gerry Cody, El Segundo, CA (US); Pitt Lau, Kowloon (HK)

(73) Assignee: MATTEL, INC., El Segundo, CA (US)

( * ) Notice: Subject to any disclaimer, the term of this patent is extended or adjusted under 35 U.S.C. 154(b) by 213 days.

This patent is subject to a terminal disclaimer.

(21) Appl. No.: 18/738,286

(22) Filed: Jun. 10, 2024

(65) Prior Publication Data

US 2025/0018310 A1 Jan. 16, 2025

Related U.S. Application Data

(63) Continuation of application No. 18/352,327, filed on Jul. 14, 2023, now Pat. No. 12,011,673.

(51) Int. Cl.

| | |
|---|---|
| ***A63H 17/00*** | (2006.01) |
| ***A63H 17/26*** | (2006.01) |
| ***A63H 29/22*** | (2006.01) |
| ***A63H 30/04*** | (2006.01) |
| ***A63H 31/02*** | (2006.01) |

(52) U.S. Cl.

CPC ..... *A63H 17/00* (2013.01); *A63H 17/004* (2013.01); *A63H 17/26* (2013.01); *A63H 29/22* (2013.01); *A63H 30/04* (2013.01); *A63H 31/02* (2013.01)

(58) Field of Classification Search

CPC ..... A63H 17/00; A63H 17/26; A63H 17/262; A63H 17/004

See application file for complete search history.

(56) References Cited

U.S. PATENT DOCUMENTS

| | | | |
|---|---|---|---|
| 1,108,725 | A | 8/1914 | Duncan |
| 1,663,169 | A | 3/1928 | Marx |
| 1,819,545 | A | 8/1931 | Delp |
| 3,653,149 | A | 4/1972 | Prodger et al. |
| 4,485,586 | A | 12/1984 | Halford |
| 4,626,223 | A | 12/1986 | Sweet |
| 4,655,727 | A | 4/1987 | Swisher et al. |

(Continued)

FOREIGN PATENT DOCUMENTS

| | | | |
|---|---|---|---|
| EP | 1077076 | A1 | 2/2001 |
| WO | 2004082792 | A1 | 9/2004 |

*Primary Examiner* — Eugene L Kim
*Assistant Examiner* — Alyssa M Hylinski
(74) *Attorney, Agent, or Firm* — Edell, Shapiro & Finnan, LLC

(57) ABSTRACT

A toy vehicle includes a toy vehicle body and a pair of wheel supports located on opposite sides of the toy vehicle body. In one embodiment, each of the wheel supports includes a pair of wheels rotatably mounted to the wheel support. The toy vehicle has a drive system that includes a pair of motors, each of which is operable to move one of the wheel supports and the wheels coupled to the wheel support. Each wheel support is movable between a retracted position in which the wheel support extends along a side of the toy vehicle body, and an extended position in which the wheel support extends downwardly from the toy vehicle body with a front end of the wheel support being spaced apart from the toy vehicle body.

20 Claims, 18 Drawing Sheets

(56) References Cited

U.S. PATENT DOCUMENTS 4,666,420 A 5/1987 Nagano
4,696,655 A * 9/1987 D'Andrade ..... A63H 17/262 446/469
4,705,487 A 11/1987 Ishimoto
4,744,781 A 5/1988 Ostendorff et al.
4,894,042 A 1/1990 Kamikawa
5,022,884 A 6/1991 Hippely et al.
5,267,888 A 12/1993 Hippely et al.
5,372,534 A * 12/1994 Levy ..... A63H 17/26 446/457
5,527,059 A * 6/1996 Lee, Jr. ..... A63H 17/262 280/43.23
5,626,506 A * 5/1997 Halford ..... A63H 33/003 446/470
5,643,041 A * 7/1997 Mukaida ..... A63H 31/00 446/466
5,868,600 A * 2/1999 Watanabe ..... A63H 17/262 446/466
6,132,287 A * 10/2000 Kuralt ..... A63H 17/004 446/431
6,394,876 B1 5/2002 Ishimoto
6,589,098 B2 * 7/2003 Lee ..... A63H 17/004 446/469
6,749,482 B1 6/2004 Hollis et al.
6,752,684 B1 * 6/2004 Lee ..... A63H 17/18 446/457
6,758,719 B1 7/2004 Nava
6,764,376 B2 7/2004 Agostini et al.
6,767,272 B2 7/2004 Santarsiero
6,793,555 B1 * 9/2004 Tilbor ..... A63H 30/04 446/466
6,926,581 B2 * 8/2005 Lynders ..... A63H 29/22 446/466
7,121,917 B2 10/2006 Hardouin et al.
7,234,992 B2 * 6/2007 Weiss ..... A63H 30/04 446/454
7,261,615 B2 8/2007 Hoeting et al.
7,722,430 B2 * 5/2010 Hippely ..... A63H 17/004 446/431
8,900,031 B2 12/2014 Benedict et al.
9,457,647 B2 10/2016 Meager
12,011,673 B1 * 6/2024 Payne ..... A63H 17/262
2001/0014569 A1 8/2001 Baker
2001/0027078 A1 * 10/2001 Lee ..... A63H 17/00 446/454
2001/0044255 A1 * 11/2001 Lee ..... A63H 17/004 446/469
2002/0065021 A1 5/2002 Wang
2002/0077026 A1 6/2002 Li
2003/0082990 A1 5/2003 Lynders et al.
2003/0224695 A1 12/2003 Kislevitz et al.
2004/0198170 A1 10/2004 Tilbor et al.
2004/0198171 A1 10/2004 Yoneda
2005/0148282 A1 7/2005 Moll et al.
2005/0287924 A1 12/2005 Haney
2006/0270310 A1 11/2006 Campbell et al.
2006/0270313 A1 11/2006 Campbell
2006/0270315 A1 11/2006 Campbell
2006/0270316 A1 11/2006 Campbell et al.
2006/0270317 A1 11/2006 Campbell
2006/0270318 A1 11/2006 Campbell
2006/0270319 A1 11/2006 Campbell
2006/0270320 A1 11/2006 Proch
2006/0270321 A1 11/2006 Benedict
2008/0070475 A1 3/2008 Hippely
2014/0248821 A1 9/2014 Hippely et al.
2014/0273728 A1 9/2014 Rehkemper et al.

* cited by examiner

TOY VEHICLE WITH MOVABLE WHEEL SUPPORTS

CROSS-REFERENCE TO RELATED APPLICATION

This application is a continuation application of and claims the benefit of and priority under 35 U.S.C. § 120 to U.S. patent application Ser. No. 18/352,327, entitled "Toy Vehicle With Movable Wheel Supports," filed Jul. 14, 2023, the entire disclosure of which is incorporated by reference herein in its entirety.

FIELD OF THE INVENTION

The present application relates generally to a toy vehicle, and more specifically, to a toy vehicle with movable or repositionable wheel supports having wheels coupled thereto.

BACKGROUND

Conventional toy vehicles usually have multiple wheels and can be moved along a support surface. Some toy vehicles include a motor that can be operated to drive the wheels so the toy vehicles travel along the support surface. Some toy vehicles can be controlled using a remote control.

There is a need for a toy vehicle that provides new features and a new way to play. There is also a need for a toy vehicle that can be maneuvered to drive in a different manner.

SUMMARY

A toy vehicle includes a toy vehicle body and a pair of wheel supports located on opposite sides of the toy vehicle body. In one embodiment, each of the wheel supports includes a pair of wheels rotatably mounted to the wheel support. The toy vehicle has a drive system that includes a pair of motors, each of which is operable to move one of the wheel supports and the wheels coupled to the wheel support. Each wheel support is movable between a retracted position in which the wheel support extends along a side of the toy vehicle body, and an extended position in which the wheel support extends downwardly from the toy vehicle body with a front end of the wheel support being spaced apart from the toy vehicle body.

Each wheel support includes a longitudinal axis that extends parallel to the longitudinal axis of the toy vehicle body when the wheel support is in its retracted position, and that extends in a direction not parallel to the longitudinal axis of the toy vehicle body when the wheel support is in its extended position. The wheel supports are independently movable relative to the toy vehicle body and can be placed in their retracted positions or in their extended positions simultaneously. Each wheel support can also be placed in different ones of its retracted and extended positions relative to the current position of the other wheel support.

In one embodiment of a toy vehicle according to the present invention, the toy vehicle comprises a body including a drive system, a first wheel support pivotally coupled to the body, the first wheel support being movable by the drive system between a first position and a second position relative to the body, a first pair of wheels mounted to the first wheel support, the first pair of wheels including a first front wheel and a first rear wheel, a second wheel support pivotally coupled to the body, the second wheel support being movable by the drive system between a third position and a fourth position relative to the body, and a second pair of wheels mounted to the second wheel support, the second pair of wheels including a second front wheel and a second rear wheel.

In one embodiment, the first wheel support and the second wheel support are independently movable by the drive system. In an alternative embodiment, when the first wheel support is in its first position, the first wheel support extends along the body, and when the second wheel support is in its third position, the second wheel support extends along the body. In another embodiment, the first wheel support is in its first position, each of the first front wheel and the first rear wheel is adjacent to the body. Additionally, when the first wheel support is in its second position, the first rear wheel is adjacent to the body and the first front wheel is in a lowered position spaced apart from the body.

In another embodiment, the first wheel support is coupled to the body via a first pivot, the first wheel support rotates about the first pivot between the first position and the second position, and the first pivot is proximate the first rear wheel. In another embodiment, when the first wheel support in its first position, the first wheel support extends parallel to the second wheel support when the second wheel support in its third position. In yet another embodiment, when the first wheel support is moved to its second position and the second wheel support is in its third position, the first front wheel, the first rear wheel, and the second rear wheel engage a support surface, and the second front wheel is spaced apart from the support surface.

In yet another embodiment, the first wheel support has a first longitudinal axis, the second wheel support has a second longitudinal axis, and the body has a third longitudinal axis, the first longitudinal axis being substantially parallel to the third longitudinal axis when the first wheel support is in the first position, and the second longitudinal axis being substantially parallel to the third longitudinal axis when the second wheel support is in the third position. In an alternative embodiment, when the first wheel support is in the second position, the first longitudinal axis is not parallel to the third longitudinal axis, and when the second wheel support is in the fourth position, the second longitudinal axis is not parallel to the third longitudinal axis.

In another embodiment of a toy vehicle according to the present invention, the toy vehicle comprises a body having front end and a rear end opposite the front end, the body having a first side portion and a second side portion opposite the first side portion, a first wheel support coupled to the body, the first wheel support being drivable between a first position in which the first wheel support extends along the first side portion and a second position in which the first wheel support extends away from the body, the first wheel support including a first wheel coupled thereto, a second wheel support coupled to the body, the second wheel support being drivable between a third position in which the second wheel support extends along the second side portion and a fourth position in which the second wheel support extends away from the body, the second wheel support including a second wheel coupled thereto, wherein the first wheel support and the second wheel support are independently movable relative to the body.

In an alternative embodiment, when the first wheel support is in its second position and the second wheel support is in its third position, the first wheel coupled to the first wheel support engages a support surface, and the second wheel coupled to the second wheel support is spaced apart from the support surface. In yet another embodiment, the body includes a drive system that can be actuated to move the first wheel support relative to the body and the second wheel support relative to the body. In another embodiment, the first wheel support and the second wheel support are parallel to each other when the first wheel support is in its first position and the second wheel support is in its third position.

In another alternative embodiment, the first wheel support and the second wheel support are not parallel to each other when the first wheel support is in its second position and the second wheel support is in its third position. In yet another embodiment, the first wheel support includes a first rear wheel coupled thereto, the second wheel support includes a second rear wheel coupled thereto, and each of the first rear wheel and the second rear wheel engages a support surface when the first wheel support is in either of its first position or its second position, and when the second wheel support is in either of its third position or its fourth position. Alternatively, each of the first wheel support and the second wheel support has a longitudinal axis, the longitudinal axes of the first wheel support and the second wheel support being substantially parallel to each other when the first wheel support is in the first position and the second wheel support is in the third position, and the longitudinal axes of the first wheel support and the second wheel support are not parallel to each other when first wheel support is in the second position and the second wheel support is in the fourth position.

In a method of moving a toy vehicle according to the present invention, the toy vehicle includes a body, a drive system, a first wheel support pivotally coupled to the body and movable by the drive system between a first position and a second position relative to the body, a second wheel support pivotally coupled to the body, the second wheel support being movable by the drive system between a third position and a fourth position relative to the body. The method comprises the steps of driving the first wheel support from its first position to its second position in which the first wheel support extending downwardly from the body, moving the toy vehicle along a support surface, driving the first wheel support from its second position to its first position in which the first wheel support extends along a side of the body, driving the second wheel support from its third position to its fourth position in which the second wheel support extends downwardly from the body, and moving the toy vehicle along the support surface.

In one embodiment, the step of driving the first wheel support from its first position to its second position includes pivoting the first wheel support relative to the body. In another embodiment, the step of driving the first wheel support from its first position to its second position includes actuating the drive system to move the first wheel support relative to the body.

Other systems, methods, features and advantages will be, or will become, apparent to one with skill in the art upon examination of the following figures and detailed description. All such additional systems, methods, features and advantages are included within this description, are within the scope of the claimed subject matter.

BRIEF DESCRIPTION OF THE DRAWINGS

The toy vehicle presented herein may be better understood with reference to the following drawings and description. Unless dimensions of elements of the drawings are specifically called-out and described herein, it should be understood that the elements in the figures are not necessarily to scale and that emphasis has been placed upon illustrating the principles of the toy vehicle booster. In the figures, like-referenced numerals designate corresponding parts throughout the different views.

DETAILED DESCRIPTION

The present invention relates to a toy vehicle that includes a toy vehicle body and a pair of wheel supports located on opposite sides of the toy vehicle body. In one embodiment, each of the wheel supports includes a pair of wheels rotatably mounted to the wheel support. The toy vehicle has a drive system that includes a pair of motors, each of which is operable to move one of the wheel supports and the wheels coupled to the wheel support. Each wheel support is movable between a retracted position in which the wheel support extends along a side of the toy vehicle body, and an extended position in which the wheel support extends downwardly from the toy vehicle body with a front end of the wheel support being spaced apart from the toy vehicle body.

Figure 1:
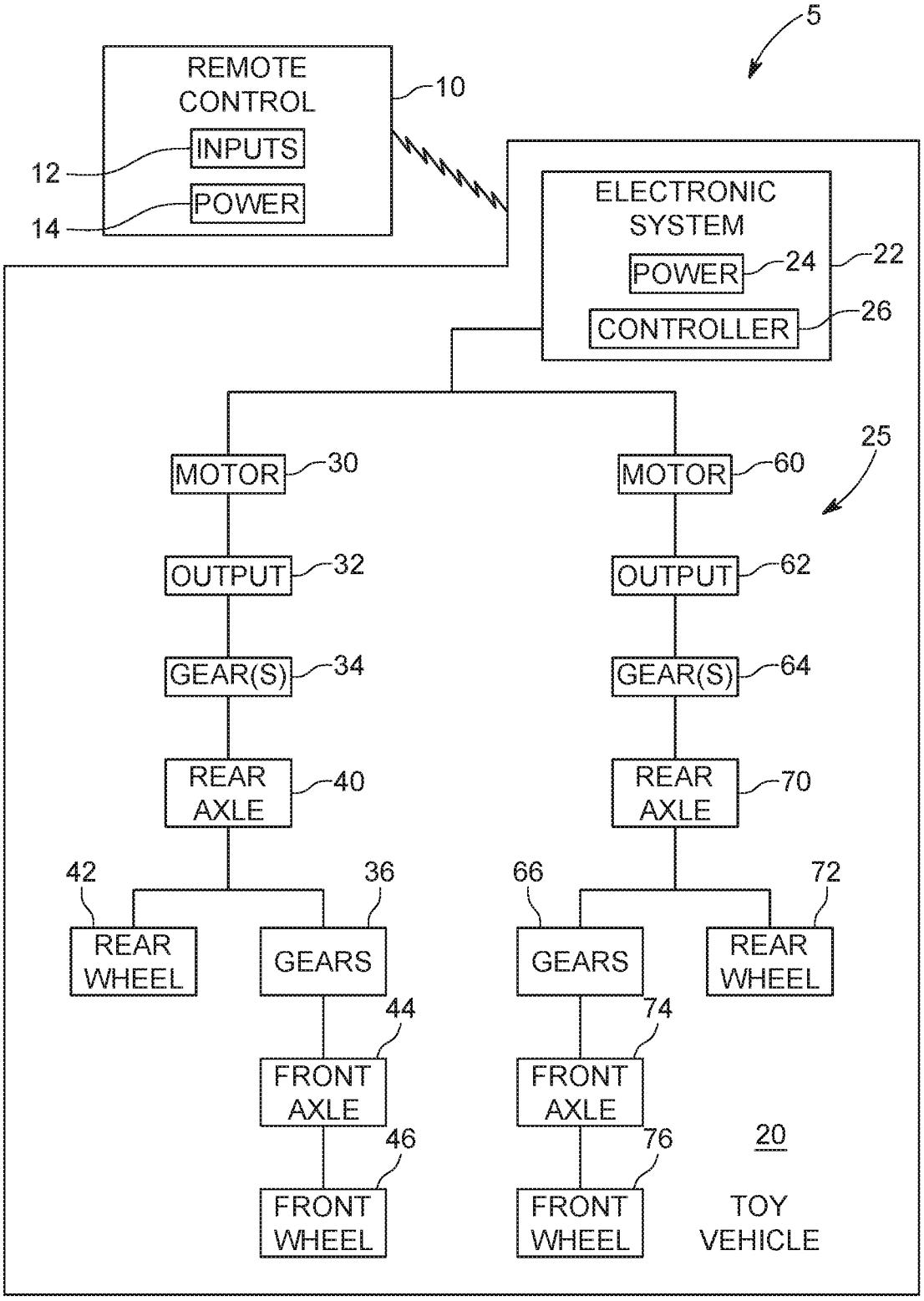
FIG. 1 is a schematic drawing of an embodiment of a toy vehicle system according to the present invention.

FIG. 1 is a schematic diagram of an embodiment of a toy vehicle system according to the present invention. In this embodiment, the toy vehicle system 5 includes a remote control 10 and a toy vehicle 20. The remote control 10 includes several inputs 12 and a power source 14, such as batteries. The inputs 12 can include one or more directional inputs, such as directional sticks or directional pads that can be used to move the toy vehicle 20 forward or backward and/or steer the toy vehicle 20.

An exemplary embodiment of the toy vehicle 20 is shown in FIG. 1. The toy vehicle 20 includes an electronic system 22 that includes a power source 24 and a controller 26. In one embodiment, the power source 24 is a rechargeable battery. It is to be understood that each of remote control 10 and the electronic system 22 includes wireless communication components (not shown) that facilitate communications between the remote control 10 and the electronic system 22.

The toy vehicle 20 includes a drive system or drive assembly 25, which is shown in the schematic diagram of FIG. 1. In one embodiment, the drive system 25 includes two motors 30 and 60, each of which can be independently operated. A user can actuate motor 30 and motor 60 simultaneously to drive the toy vehicle 20 forward or backward on a support surface. Also, a user can actuate either motor 30 or motor 60 to turn the toy vehicle 20 toward the left or toward the right, as desired. Motor 30 has an output 32 coupled thereto, which in this embodiment, is a gear mounted on the output shaft of the motor 30. Similarly, motor 60 has an output 62 coupled thereto, which is a gear coupled to the output shaft of the motor 60.

The drive system 25 includes one or more gears 34 that are positioned downstream of motor 30. In one embodiment, a single gear 34 is in engagement with the teeth of output 32 of motor 30. In another embodiment, one gear 34 is in engagement with the teeth of output 32 of motor 30, and at least one additional gear is engaged with the teeth of gear 34. Similarly, the drive system 25 includes one or more gears 64 that are positioned downstream of motor 60. In different embodiments, either a single gear 64 or multiple gears 64 are provided.

Referring back to gear 34, toy vehicle 20 includes a rear axle 40 to which a rear wheel 42 is coupled. In this embodiment, the rear wheel 42 is fixedly coupled to the rear axle 40 such that when the rear axle 40 rotates, the rear wheel 42 rotates as well. The rear axle 40 includes teeth that can engage the teeth of gear 34. In one embodiment, the teeth of rear axle 40 can be formed integrally with the axle. In another embodiment, a separate gear or ring can be coupled to the rear axle 40, and that separate gear or ring can include teeth formed thereon. Thus, when gear 34 is driven, gear 34 drives rear axle 40 and causes rear wheel 42 to rotate as well.

Similarly, toy vehicle 20 includes another rear axle 70 to which another rear wheel 72 is coupled. Rear wheel 72 is fixedly coupled to the rear axle 70 such that when the rear axle 70 rotates, the rear wheel 72 rotates as well. The rear axle 70 includes teeth that can engage the teeth of gear 64. In one embodiment, the teeth of rear axle 70 can be formed integrally with the axle. In another embodiment, a separate gear or ring can be coupled to the rear axle 70, and that separate gear or ring can include teeth formed thereon. Thus, when gear 64 is driven, gear 64 drives rear axle 70 and rear wheel 72 to rotate as well. Notably, each of the gears 34 and 64 is driven independently from each other because of their coupling to motors 30 and 60, respectively. It is to be understood that motors 30 and 60 can be operated simultaneously or at different times from each other. In addition, motors 30 and 60 can be operated in the same direction or in opposite directions from each other. As a result, gears 34 and 64, rear axles 40 and 70, and rear wheels 42 and 72 can be rotated respectively relative to each other in a variety of manners.

Referring to FIG. 1, the drive system 25 includes a set of gears 36, one of which is engaged with the teeth associated with rear axle 40. As rear axle 40 rotates, the gear 36 in engagement with rear axle 40 also rotates. The set of gears 36 includes several gears that are arranged laterally in series, with each gear in the set of gears 36 being engaged with at least one other gear in the set. The drive system 25 also includes a front axle 44 to which a front wheel 46 is coupled. The front axle 44 is spaced apart from the rear axle 40. The set of gears 36 are located between the rear axle 40 and the front axle 44. As the rear axle 40 rotates, the rear axle 40 is engaged the first gear in the set of gears 36, thereby causing that gear to rotate. Each gear in the set of gears 36 rotates and the last gear in the set is engaged with the front axle 44, thereby causing it to rotate. As front axle 44 rotates, it causes the front wheel 46 to rotate. When motor 30 operates, it causes rear axle 40 and front axle 44 to rotate, and as a result, rear wheel 42 and front wheel 46 to rotate.

The drive system 25 also includes another front axle 74, which is similar to front axle 44. The drive system includes another set of gears 66, one of which is engaged with the teeth associated with rear axle 70. As rear axle 70 rotates, the engaged gear in the set of gears 66 also rotates. The set of gears 66 includes several gears that are arranged laterally in series, with each gear in the set of gears 66 being engaged with at least one other gear in the set. The front axle 74 includes a front wheel 76 coupled thereto. The front axle 74 is spaced apart from the rear axle 70. The set of gears 66 are located between the rear axle 70 and the front axle 74. As the rear axle 70 rotates, the rear axle 70 is engaged with and causes the first gear in the set, which is engaged with the rear axle 70, to rotate. Each gear in the set of gears 66 rotates and the last gear in the set is engaged with the front axle 74, thereby causing it to rotate. As front axle 74 rotates, it causes the front wheel 76 to rotate. When motor 60 operates, it causes rear axle 70 and front axle 74 to rotate, and as a result, rear wheel 72 and front wheel 76 to rotate.

Figure 2:
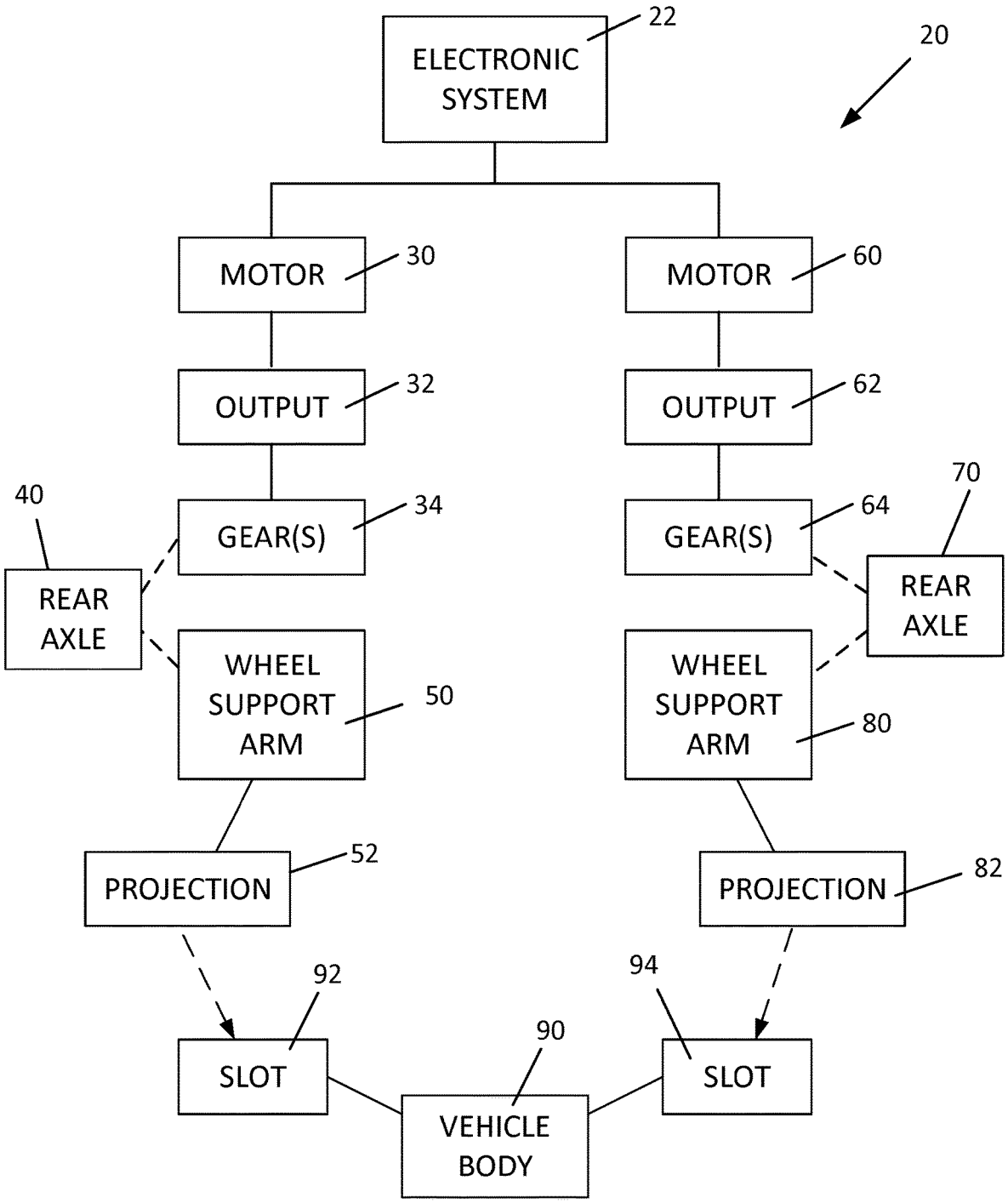
FIG. 2 is a schematic drawing of some components of the toy vehicle illustrated in FIG. 1, according to the present invention.

Turning to FIG. 2, a schematic view of additional components of the toy vehicle 20 is illustrated. Toy vehicle 20 includes a pair of wheel support arms 50 and 80 that are pivotally mounted to the body of the toy vehicle 20. As discussed above with respect to FIG. 1, toy vehicle 20 has an electronic system 22 that is connected to motors 30 and 60, which in turn are connected to output 32 and gear 34 and to output 62 and gear 64, respectively. In one embodiment, gear 34 has a first set of teeth formed thereon that engage with rear axle 40, as described above. Gear 34 also has a second set of teeth formed thereon that engage with teeth associated with wheel support arm 50. As gear 34 rotates, not only does rear axle 40 rotate, but wheel support arm 50 also rotates. The extent to which wheel support arm 50 rotates can be limited. The wheel support arm 50 includes a projection 52 extending therefrom that is used with a limiter.

Similarly, gear 64 has a first set of teeth formed thereon that engage with rear axle 70. Gear 64 also has a second set of teeth formed thereon that engage with teeth associated with wheel support arm 80. As gear 64 rotates, not only does rear axle 70 rotate, but wheel support arm 80 also rotates. The extent to which wheel support arm 80 rotates can be limited. The wheel support arm 80 includes a projection 82 extending therefrom that is used with a limiter.

In an alternative embodiment, shown in FIG. 2 in dashed lines, gears 34 and 64 are engaged with rear axles 40 and 70, respectively, causing them to rotate when gears 34 and 64 rotate. Each of the rear axles 40 and 70 is engaged with one of the wheel support arms 50 and 80, respectively, and as a result, rotation of the rear axle causes rotation of the corresponding wheel support arm. The direct engagement may be achieved by way of the engagement of teeth on each component, an intermediate gear between a rear axle and a wheel support arm, and/or a clutch located between the rear axle and the wheel support arm. In one embodiment, a clutch allows the rear axle to continuously rotate while allowing motion of the wheel support arm to be limited.

Referring to FIG. 2, the toy vehicle 20 includes a vehicle body 90 that has a pair of slots 92 and 94 formed therein. Each of the slots 92 and 94 is arcuate and is sized to receive one of the projections 52 and 82. In particular, projection 52 travels in slot 92 and projection 82 travels in slot 94. The drive system 25 is configured so that while the range of rotation of each of wheel support arms 50 and 80 is limited by the range of travel of projections 52 and 82 in slots 92 and 94, the corresponding rear axles 40 and 70 can continue to be driven.

Figure 3:
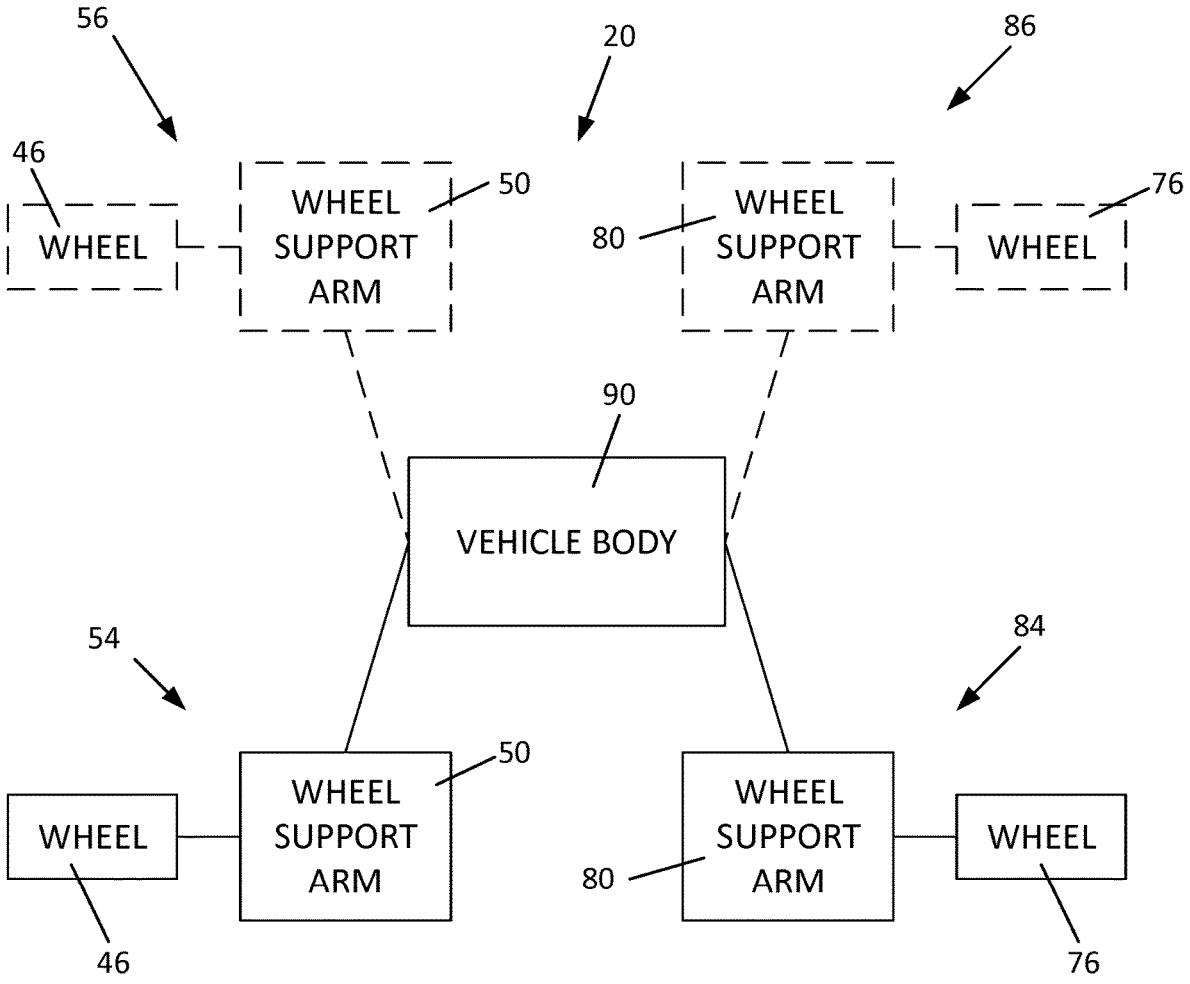
FIG. 3 is a schematic drawing of additional components of the toy vehicle illustrated in FIG. 1, according to the present invention.

Turning to FIG. 3, a schematic diagram representing the movement of the wheel support arms 50 and 80 is illustrated. Wheel support arm 50 is pivotally coupled to vehicle body 90 and includes front wheel 46 coupled thereto. In one embodiment, the wheel support arm 50 has a first end and a second end opposite to the first end. The wheel support arm 50 is coupled to the vehicle body 90 proximate to the first end, and the front wheel 46 is coupled to the wheel support arm 50 proximate to the second end.

The wheel support arm 50 can be placed in a lowered or extended position 54 by motor 30. In this extended position 54, the wheel support arm 50 is proximate to a support surface or object, thereby resulting in the front wheel 46 engaging the support surface or object. The motor 30 can be actuated to move the wheel support arm 50 to its base or retracted position 56, which is illustrated in dashed lines in FIG. 3. When wheel support arm 50 is in its retracted position 56, front wheel 46 is proximate to the toy vehicle body 90. The range of motion of wheel support arm 50 between its extended position 54 and its retracted position 56 is limited by the length of the slot 92 formed in the vehicle body 90 of toy vehicle 20.

Turning to wheel support arm 80, wheel support arm 80 is pivotally coupled to vehicle body 90 and includes front wheel 76 coupled thereto. Similar to wheel support arm 50, wheel support arm 80 has its own first end and its own second end opposite to the first end. The wheel support arm 80 is coupled to the vehicle body 90 proximate to its first end, and the front wheel 76 is coupled to the wheel support arm 80 proximate to its second end.

The wheel support arm 80 can be placed in a lowered or extended position 84 by motor 60. In this extended position 84, the wheel support arm 80 is proximate to a support surface or object, thereby resulting in the front wheel 76 engaging the support surface or object. The motor 60 can be actuated to move the wheel support arm 80 to its retracted position 86. When wheel support arm 80 is in its retracted position 86, front wheel 76 is proximate to the toy vehicle body 90. The range of motion of wheel support arm 80 between its extended position 84 and its retracted position 86 is limited by the length of the slot 94 formed in the vehicle body 90 of toy vehicle 20.

In view of the motors 30 and 60 being independently operable, wheel support arms 50 and 80 can be moved independently between their extended positions 54 and 84 and their retracted positions 56 and 86, respectively.

Figure 4:
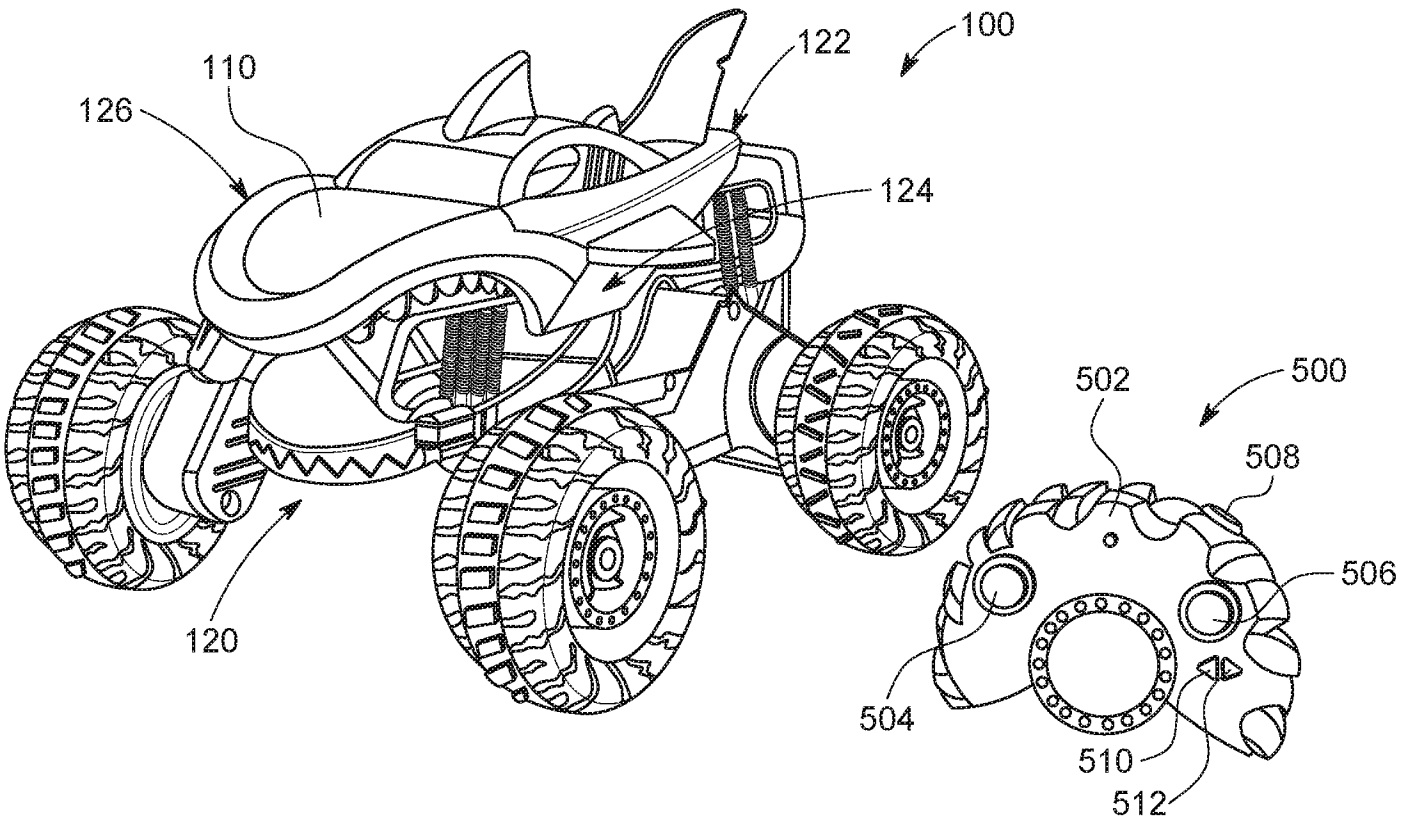
FIG. 4 is a perspective view of an embodiment of a toy vehicle assembly according to the present invention.

Turning to FIG. 4, a perspective view of an embodiment of a toy vehicle assembly or system according to the present invention is illustrated. In this embodiment, the toy vehicle system includes a toy vehicle 100 and a remote control 500. The remote control 500 can be paired with an electronic system of the toy vehicle 100 so that user inputs to the remote control 500 are sent to the toy vehicle 100 to cause certain movements to occur. In this embodiment, the remote control 500 includes a housing or body 502 and several inputs, such as a directional stick 504 used to drive the toy vehicle forward or backward, a directional stick 506 used for steering, an action button 508 used to cause the toy vehicle 100 to perform a stomping-like action (as explained in more detail below), and a pair of buttons 510 and 512 used for steering.

Toy vehicle 100 includes a body 110 with a front end 120 and an opposite rear end 122. The body 110 also includes opposite side portions 124 and 126. The various features and components of the toy vehicle 100 are described in detail relative to the following figures.

Figure 5:
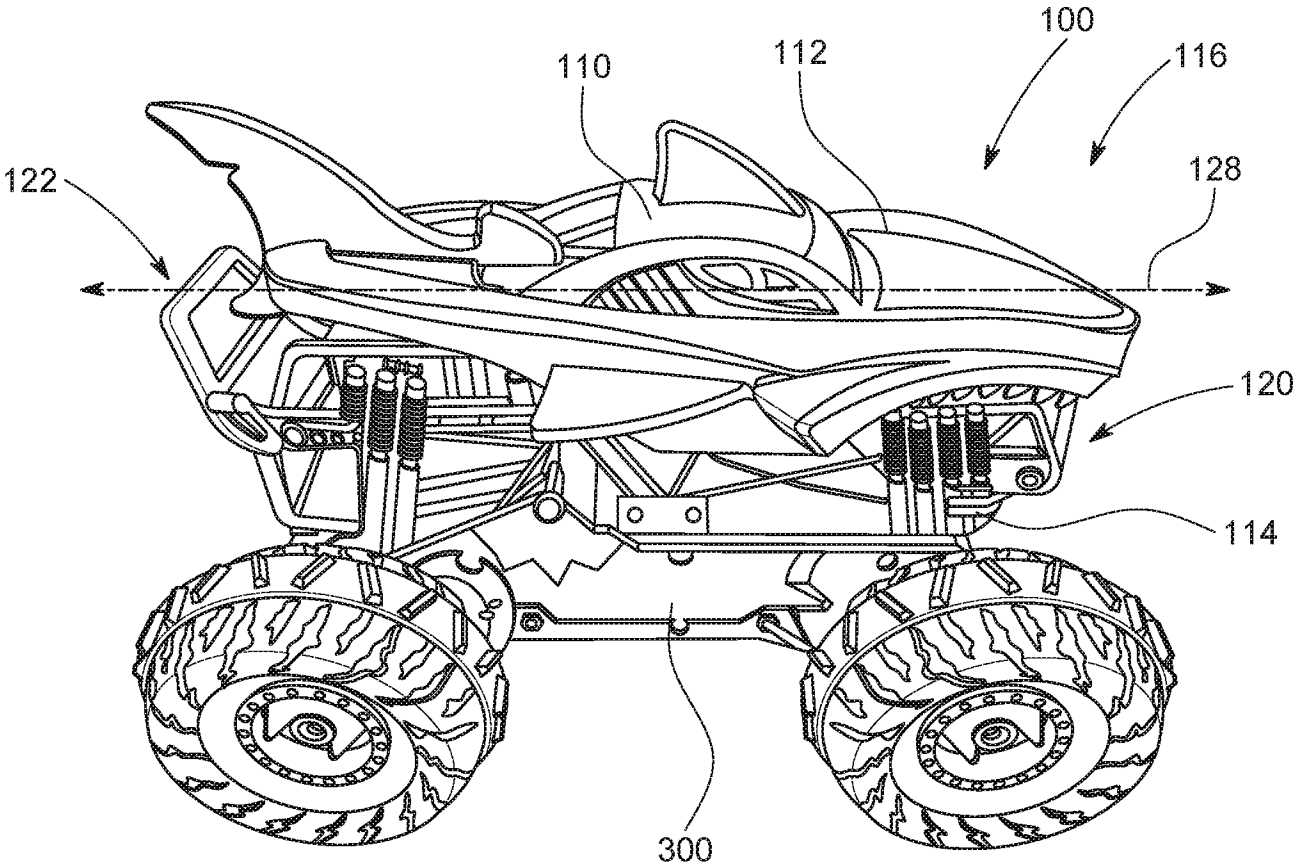
FIG. 5 is a side perspective view of the toy vehicle illustrated in FIG. 4.

Referring to FIG. 5, a perspective view of toy vehicle 100 is illustrated. Toy vehicle 100 has a body 110 that includes an upper portion 112 and a lower portion 114, with the upper portion 112 coupled to the lower portion 114 via connectors (not shown). Toy vehicle 100 also has a longitudinal axis 128 that extends from the front end 120 to the rear end 122. In FIG. 5, the toy vehicle 100 is illustrated in its lowered configuration 116. Toy vehicle 100 includes a wheel support or wheel support arm 300 to which two wheels are coupled. In this lowered configuration 116, the wheel support arm 300 is positioned proximate to the toy vehicle body 110.

Figure 6:
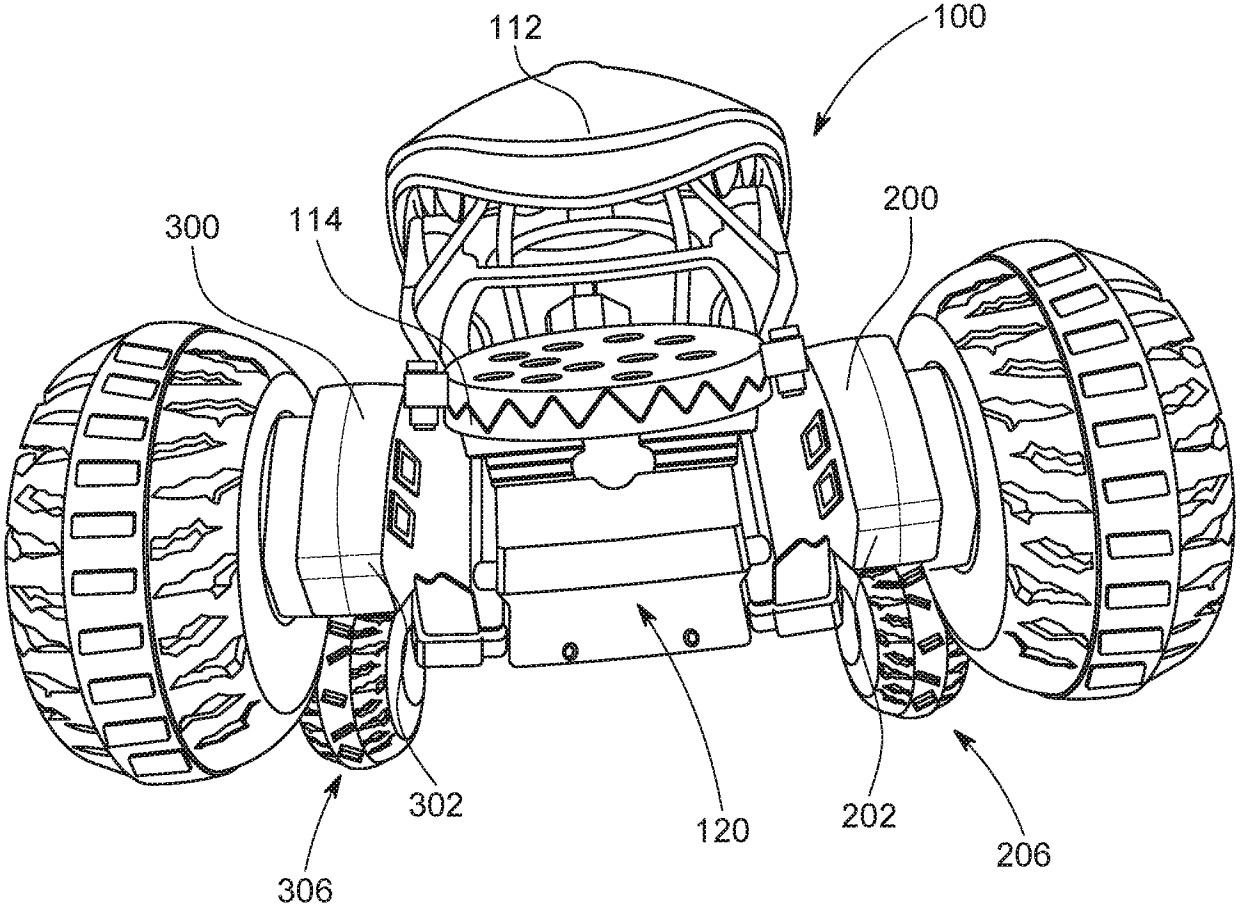
FIG. 6 is a front view of the toy vehicle illustrated in FIG. 4.
Figure 7:
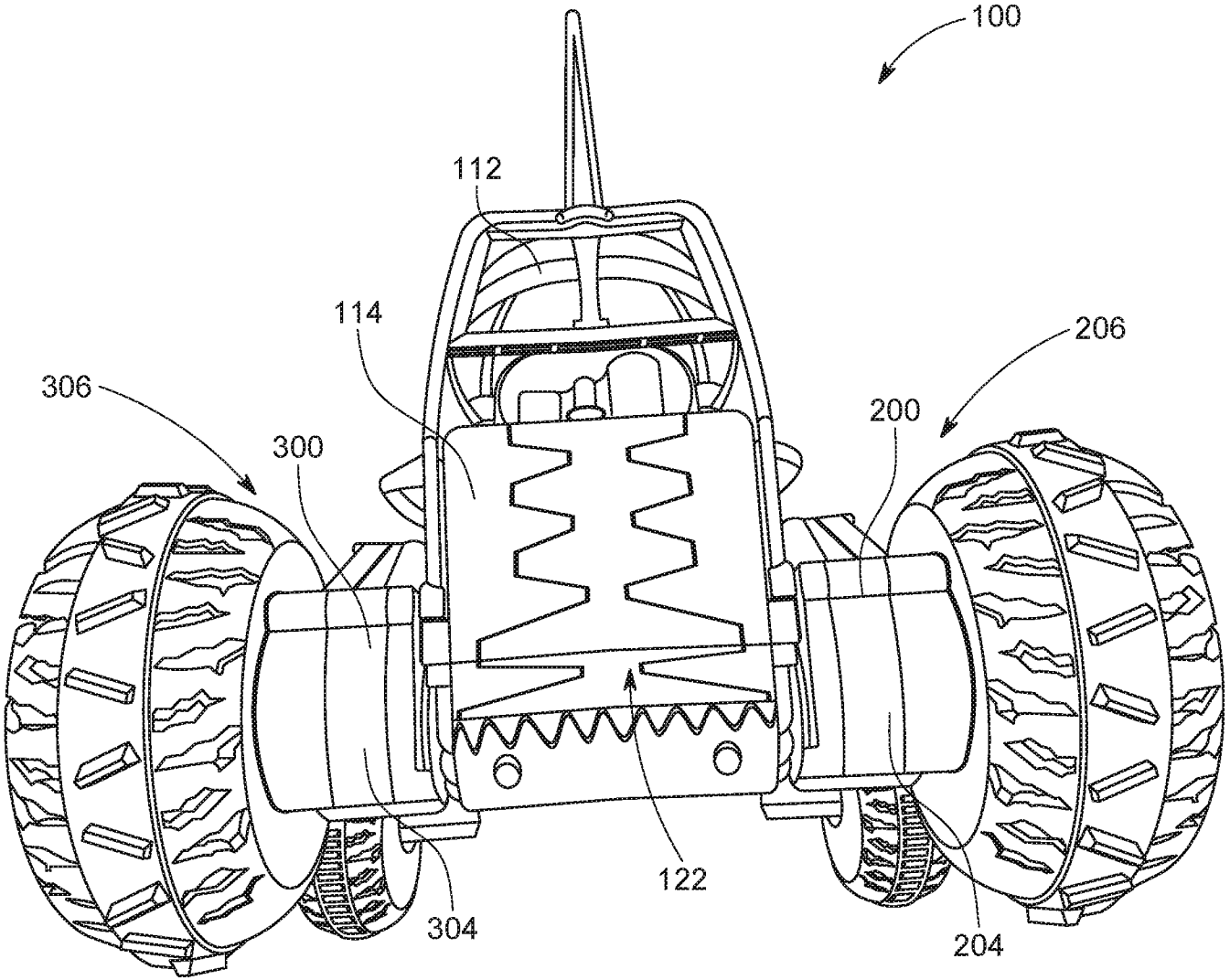
FIG. 7 is a rear view of the toy vehicle illustrated in FIG. 4.

Turning to FIGS. 6 and 7, a front view and a rear view of toy vehicle 100, respectively, are illustrated. The upper portion 112 and the lower portion 114 of the toy vehicle body 110 are visible in each of those figures. Toy vehicle 100 has a wheel support or wheel support arm 200 on one side of the toy vehicle body 110, and another wheel support or wheel support arm 300 on the other side of the toy vehicle body 110. In FIG. 6, the front ends 202 and 302 of the wheel supports 200 and 300, respectively, are located near the front end 120 of the toy vehicle 100. In FIG. 7, the rear ends 204 and 304 of the wheels supports 200 and 300, respectively, are located near the rear end 122 of the toy vehicle 100.

In both FIGS. 6 and 7, wheel support 200 is illustrated in a base or retracted position 206, and wheel support 300 is illustrated in its own base or retracted position 306. Each of the wheel supports 200 and 300 is pivotally mounted or coupled to the toy vehicle body 110. Each of the wheel supports 200 and 300 is movable and can be moved to different positions relative to the toy vehicle body 110, one of which is its retracted position 206 or 306.

When wheel support 200 is in its base or retracted position 206, wheel support 200 is proximate to and extends along the toy vehicle body 110. In particular, the wheel support 200 extends alongside portion 124 of the body 110. As described in greater detail below, wheel support 200 includes a pair of wheels coupled thereto. When wheel support 200 is in its retracted position 206, the wheels coupled to the wheel support 200 are adjacent to the toy vehicle body 110. Similarly, when wheel support 300 is in its base or retracted position 306, wheel support 300 is proximate to and extends along the toy vehicle body 110. In particular, the wheel support 300 extends alongside portion 126 of the body 110. Wheel support 300 also includes a pair of wheels coupled thereto. When wheel support 300 is in its retracted position 306, the wheels coupled to the wheel support 300 are adjacent to the toy vehicle body 110. Each of the wheel supports 200 and 300 extends parallel to each other when the wheel supports 200 and 300 are in their respective retracted positions 206 and 306.

Figure 8:
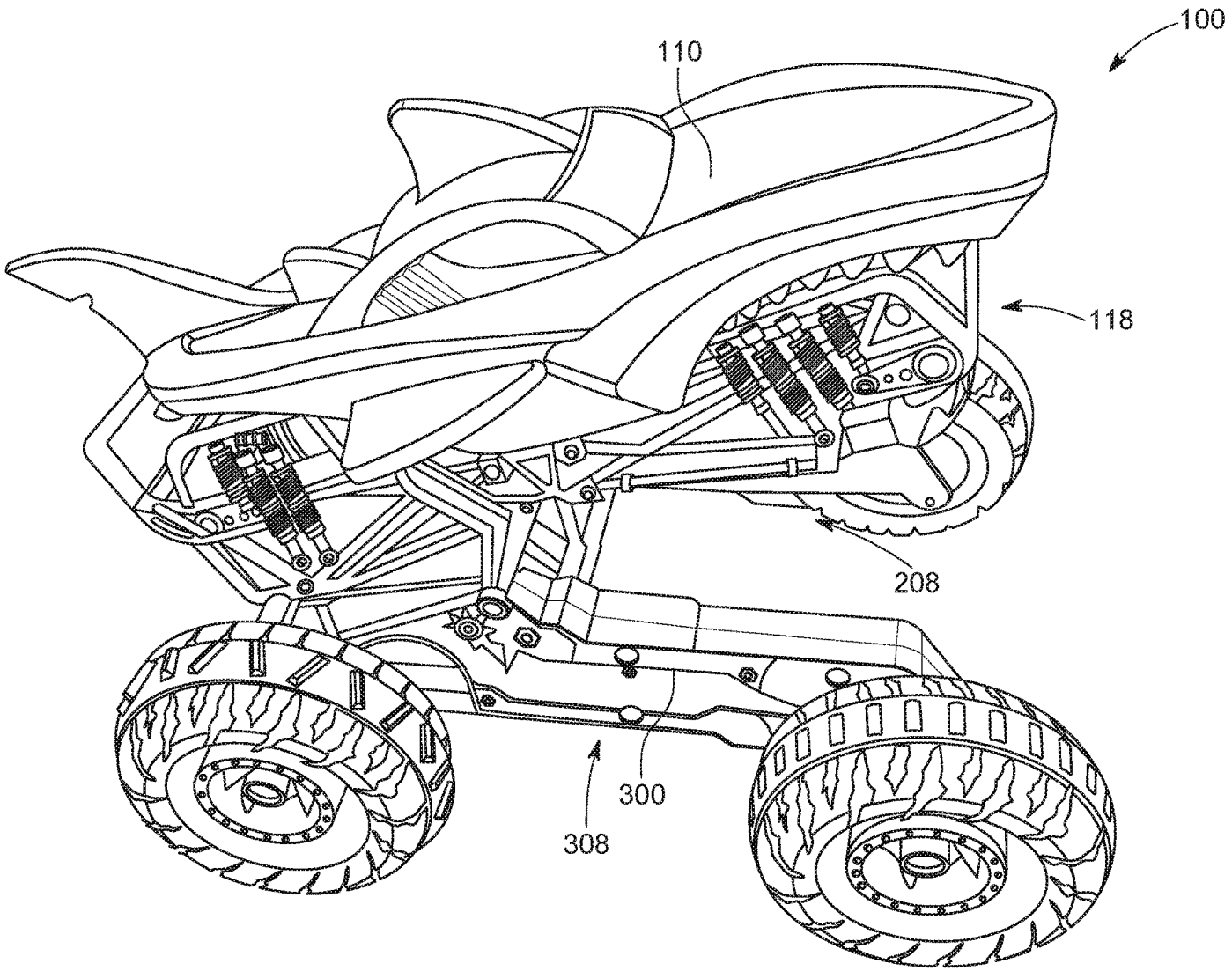
FIG. 8 is a side perspective view of the toy vehicle illustrated in FIG. 4 in a different configuration.
Figure 9:
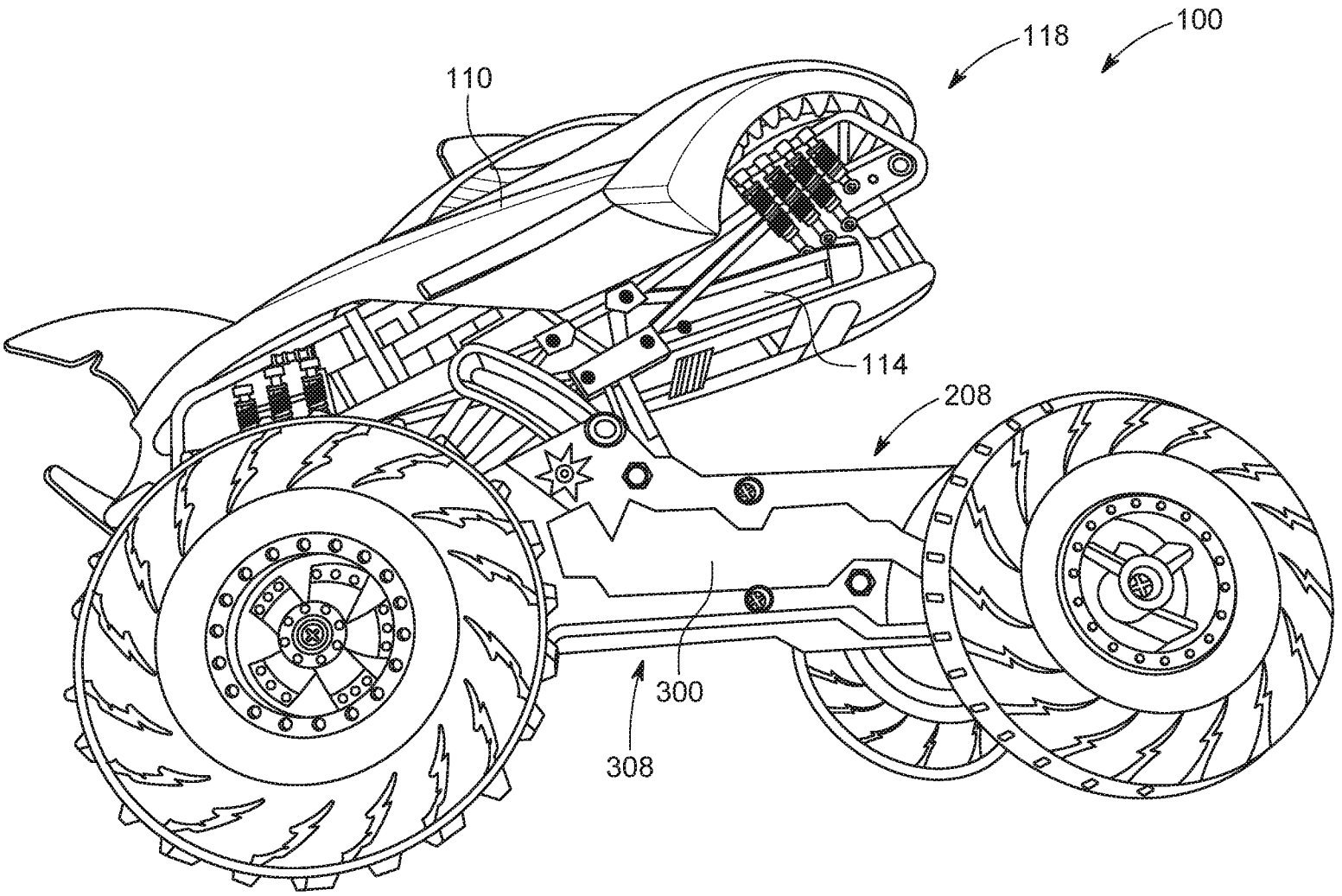
FIG. 9 is a side view of the toy vehicle illustrated in FIG. 8.

Turning to FIGS. 8 and 9, the toy vehicle 100 is illustrated in another configuration. In this configuration 118, the toy vehicle body 110 and the wheel supports 200 and 300 are spaced apart from each other at the front ends of the wheel supports 200 and 300. As a result, the toy vehicle body 110 appears to be raised and angled upward relative to a support surface on which the wheels are located. In this configuration 118, each of the wheel supports 200 and 300 has been moved to its lowered or extended position 208 and 308, respectively, by the drive system in the toy vehicle 100. In this embodiment, each of the wheel supports 200 and 300 is pivotable about an axis that is near or proximate to the rear end of the wheel support. As shown in FIG. 9, when wheel supports 200 and 300 are in their extended positions 208 and 308, the rear ends of the wheel supports 200 and 300 are still coupled to the toy vehicle body 110, and the front ends of the wheel supports 200 and 300 are moved away from the toy vehicle body 110, and in particular, the lower portion 114 of the toy vehicle body 110. In their extended positions 208 and 308, the wheel supports 200 and 300 extend downwardly from the toy vehicle body 110, and each of the wheel supports 200 and 300 extends in a direction parallel to each other.

Wheel support 200 is movable by the drive system of the toy vehicle 100 between its base or retracted position 206 and its extended position 208 relative to the toy vehicle body 110. Similarly, wheel support 300 is movable by the drive system of the toy vehicle 100 between its base or retracted position 306 and its extended position 308 relative to the toy vehicle body 110. The drive system includes two motors that operate independently of each other. The motors can be operated simultaneously, or at different times than each other. One motor is connected to wheel support 200 via one or more gears. Similarly, the other motor is connected to wheel support 300 via one or more other gears.

Figure 10:
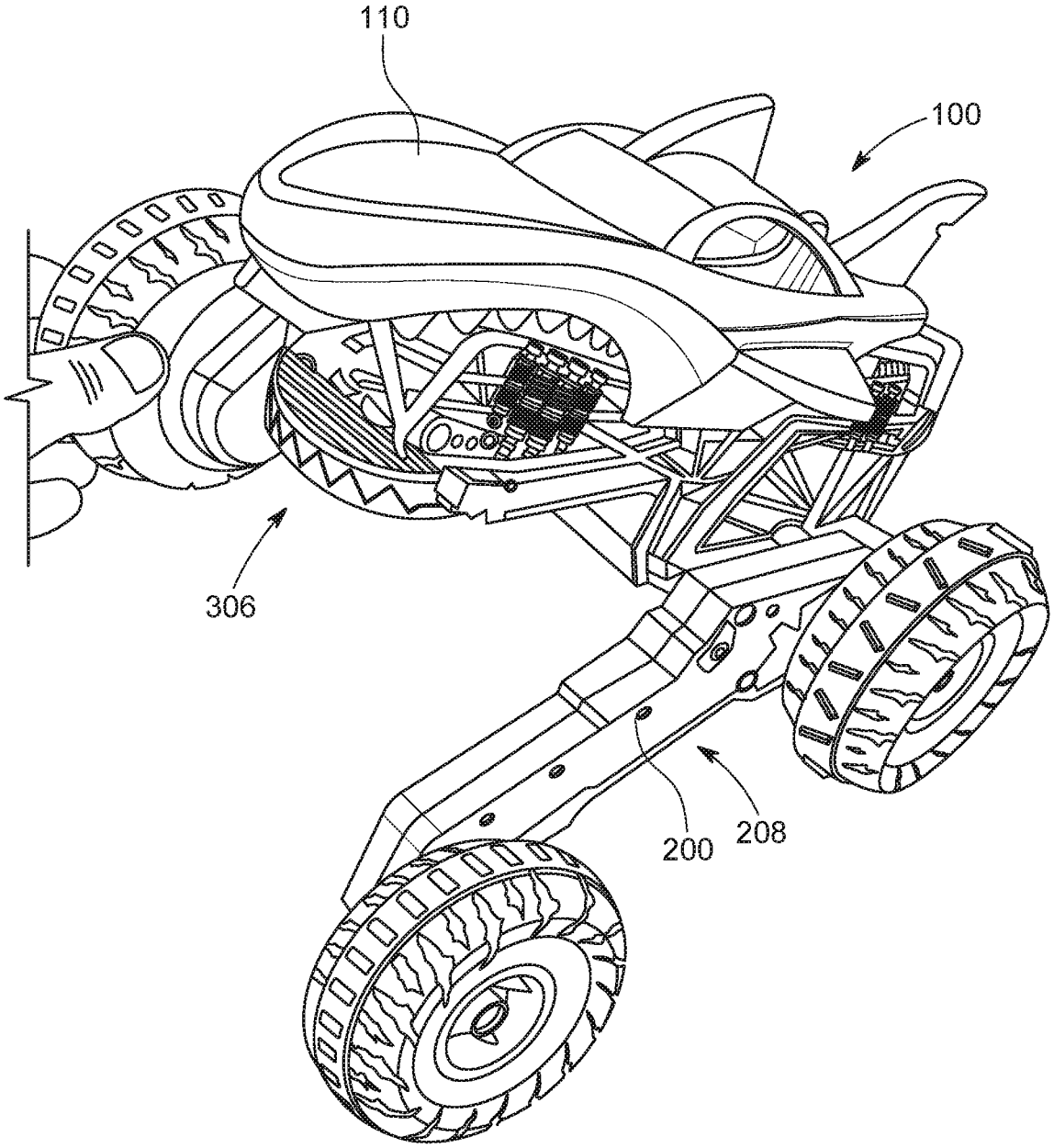
FIG. 10 is a front perspective view of the toy vehicle illustrated in FIG. 4 in another configuration.
Figure 11:
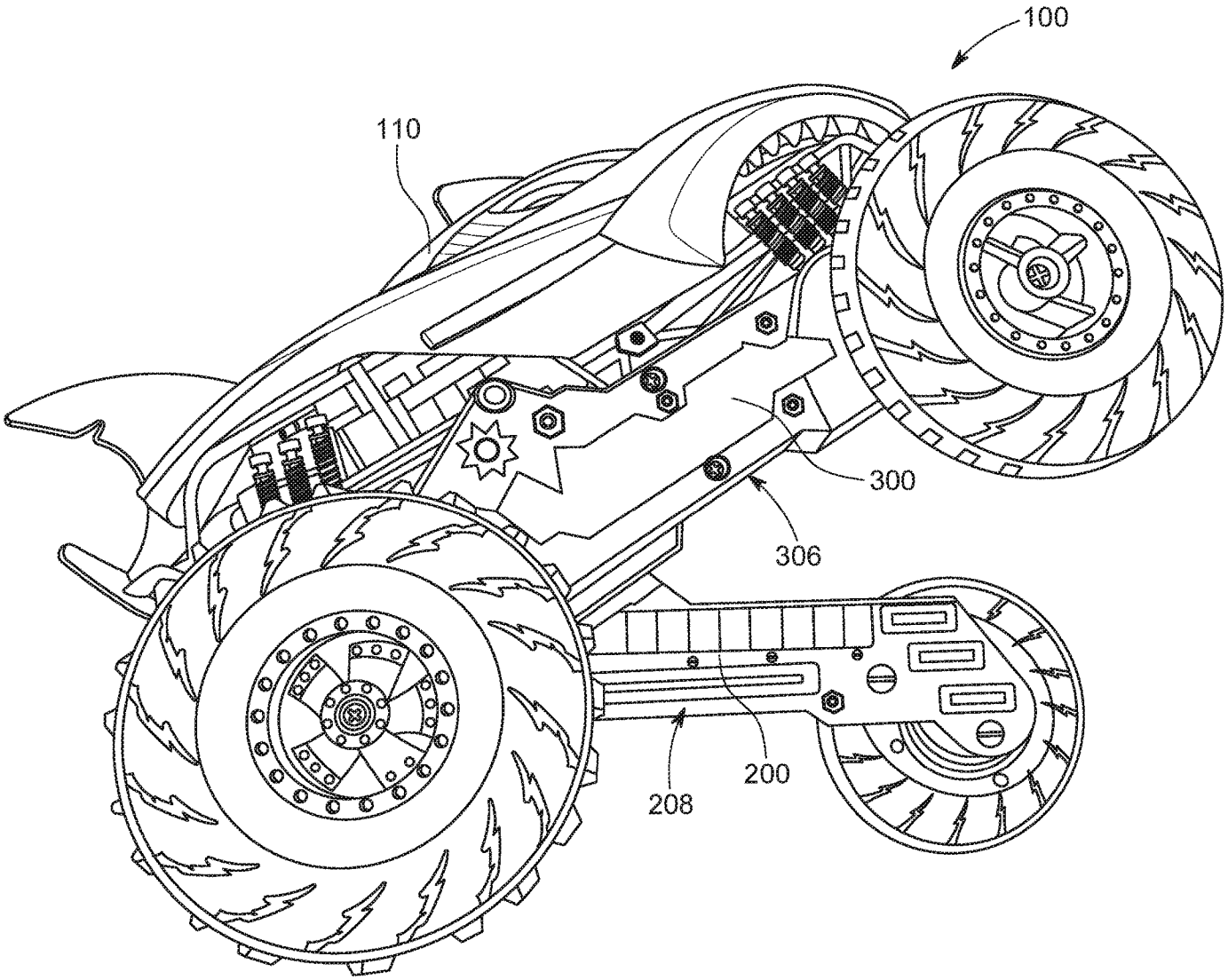
FIG. 11 is a side view of the toy vehicle illustrated in FIG. 10.

Referring to FIGS. 10 and 11, the toy vehicle 110 is illustrated in yet another configuration. In this configuration, one of the wheel supports 200 and 300 is in its base or retracted position, and the other of the wheel supports 200 and 300 is in its extended position. In this particular example, wheel support 200 is in its extended position 208 in which it extends away from the toy vehicle body 110, and wheel support 300 is in its retracted position 306 in which it extends along the side of the toy vehicle body 110. When one of the wheel supports is in its retracted position and the other of the wheel supports is in its extended position, the wheel supports extend in directions not parallel to each other.

Each of the wheel supports 200 and 300 includes a pair of wheels rotatably coupled thereto. The wheels are discussed in more detail relative to FIG. 12. Referring to FIGS. 6-11, which show the wheel supports 200 and 300 in different positions relative to the toy vehicle body 110, the corresponding positions of the wheels coupled to the wheel supports 200 and 300 are shown. When a wheel support is in its base or retracted position, both of the wheels coupled to the wheel support are proximate to the toy vehicle body 110. When a wheel support is in its extended position, its rear wheel remains proximate to the toy vehicle body 110 due to its proximity to the pivot point of the wheel support, and its front wheel is in a lowered position or spaced apart from the toy vehicle body 110.

When both of the wheel supports 200 and 300 are in their base or retracted positions 206 and 306, respectively, their front and rear wheels are engaged with a support surface or object on which the toy vehicle 100 is located (see FIGS. 6-7). When both of the wheel supports 200 and 300 are in their extended positions 208 and 308, respectively, their front and rear wheels are also engaged with a support surface or object on which the toy vehicle 100 is located (see FIGS. 8-9). However, the toy vehicle body 110 is angled upwardly relative to the support surface because the front end 120 of the toy vehicle body 110 is spaced apart from the front ends of the wheel supports 200 and 300.

When only one of the wheel supports 200 and 300 is in its retracted position and the other wheel support is in its extended position (see FIGS. 10-11), the wheels of the extended position wheel support are engaged with a support surface and only the rear wheel of the retracted position wheel support is engaged with the support surface. The front wheel of the retracted position wheel support (which is wheel support 300 in FIGS. 10-11) is spaced apart from the support surface.

The drive system can cause the wheel supports 200 and 300 to move relative to the toy vehicle body 110. In one mode of operation, a first motor of the drive system can be actuated to move wheel support 200 between its retracted position 206 and its extended position 208, and a second motor of the drive system can be actuated to move wheel support 300 between its retracted position 306 and its extended position 308. The motors can be actuated to have the wheel supports 200 and 300 in the same positions at the same time, or in different positions from each other. One exemplary mode of operation is to move the wheel supports 200 and 300 back and forth between their retracted positions and their extended positions in an alternating manner, thereby creating a stomping-like appearance of the toy vehicle along a support surface.

Figure 12:
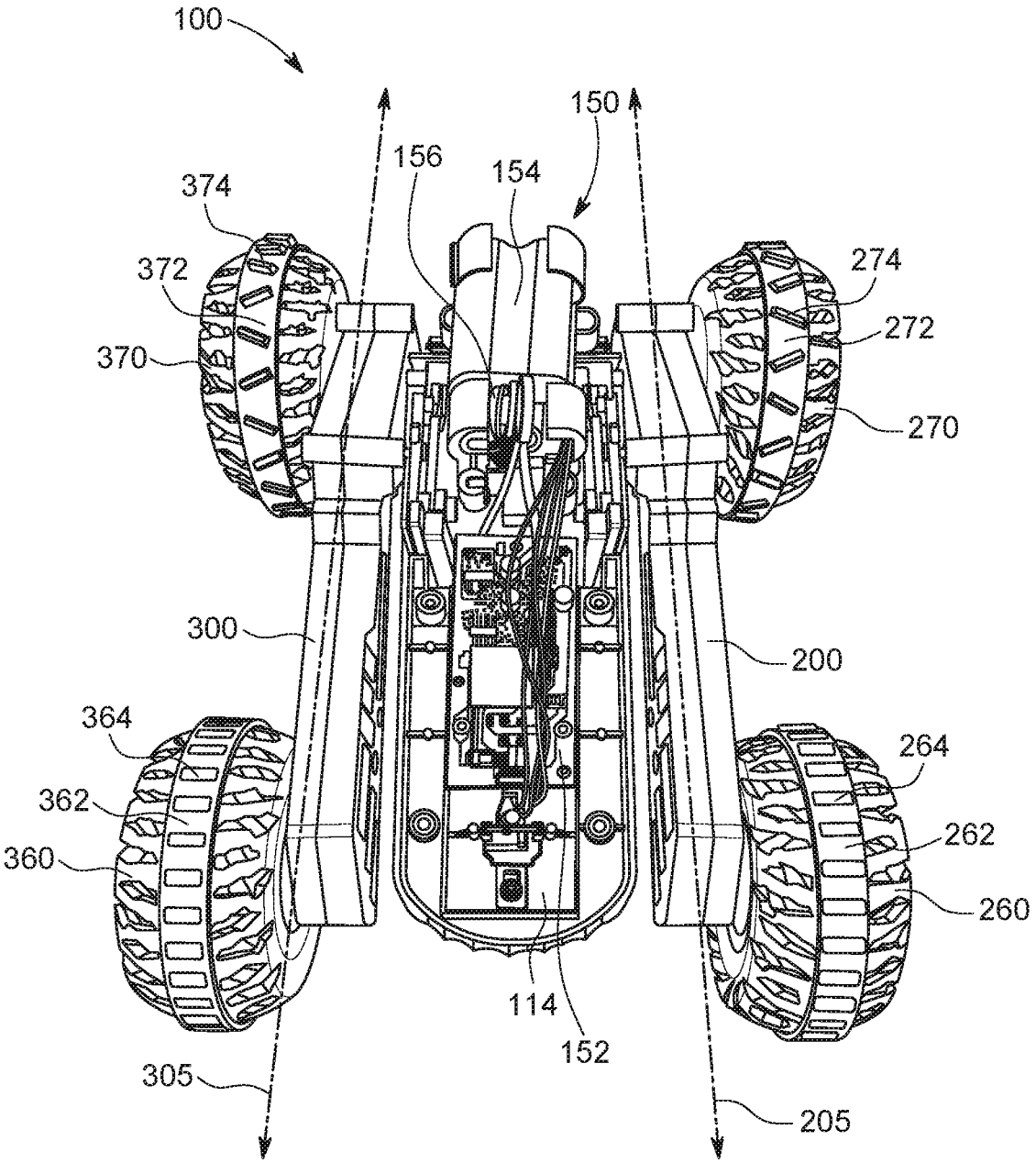
FIG. 12 is a top perspective view of the toy vehicle illustrated in FIG. 4 with the upper portion of its housing removed.

Turning to FIG. 12, various components of the toy vehicle 100 are illustrated with the upper portion 112 of the toy vehicle body 110 having been removed to simplify the discussion. The lower portion 114 of the toy vehicle body 110 is shown with wheel supports 200 and 300 on opposite sides thereof. As best seen in FIGS. 12, wheel support 200 has a longitudinal axis 205 along which it extends, and wheel support 300 has a longitudinal axis 305 along which it extends.

When a wheel support is in its retracted position relative to the toy vehicle body 110, the longitudinal axis of that wheel support extends along a direction parallel or substantially parallel to the direction in which the longitudinal axis 128 of the toy vehicle body 110 extends. When a wheel support is in its extended position relative to the toy vehicle body 110, the longitudinal axis of that wheel support extends along a direction that is not parallel to the direction in which the longitudinal axis 128 of the toy vehicle body 110 extends. When both of the wheel supports 200 and 300 are in their retracted positions at the same time, or in their extended positions at the same time, their longitudinal axes extend directions that are parallel to each other.

Referring to FIG. 12, wheel support 200 includes wheels 260 and 270 rotatably mounted thereto. Front wheel 260 includes a body with a tread member 262 with projections 264 mounted to the body. Similarly, rear wheel 270 includes a body with a tread member 272 with projections 274 mounted to the body. Wheel support 300 includes similar wheels rotatably mounted thereto. In particular, front wheel 360 includes a body with a tread member 362 with projections 364, and rear wheel 370 includes a body with a tread member 372 with projections 374 mounted to the body.

The toy vehicle 100 also has an electronic system that includes a printed circuit board (PCB) 152 with a controller mounted thereto, a power source 154 (such as a rechargeable battery), and wiring 156 connecting the power source 154 and the two motors.

Figure 13:
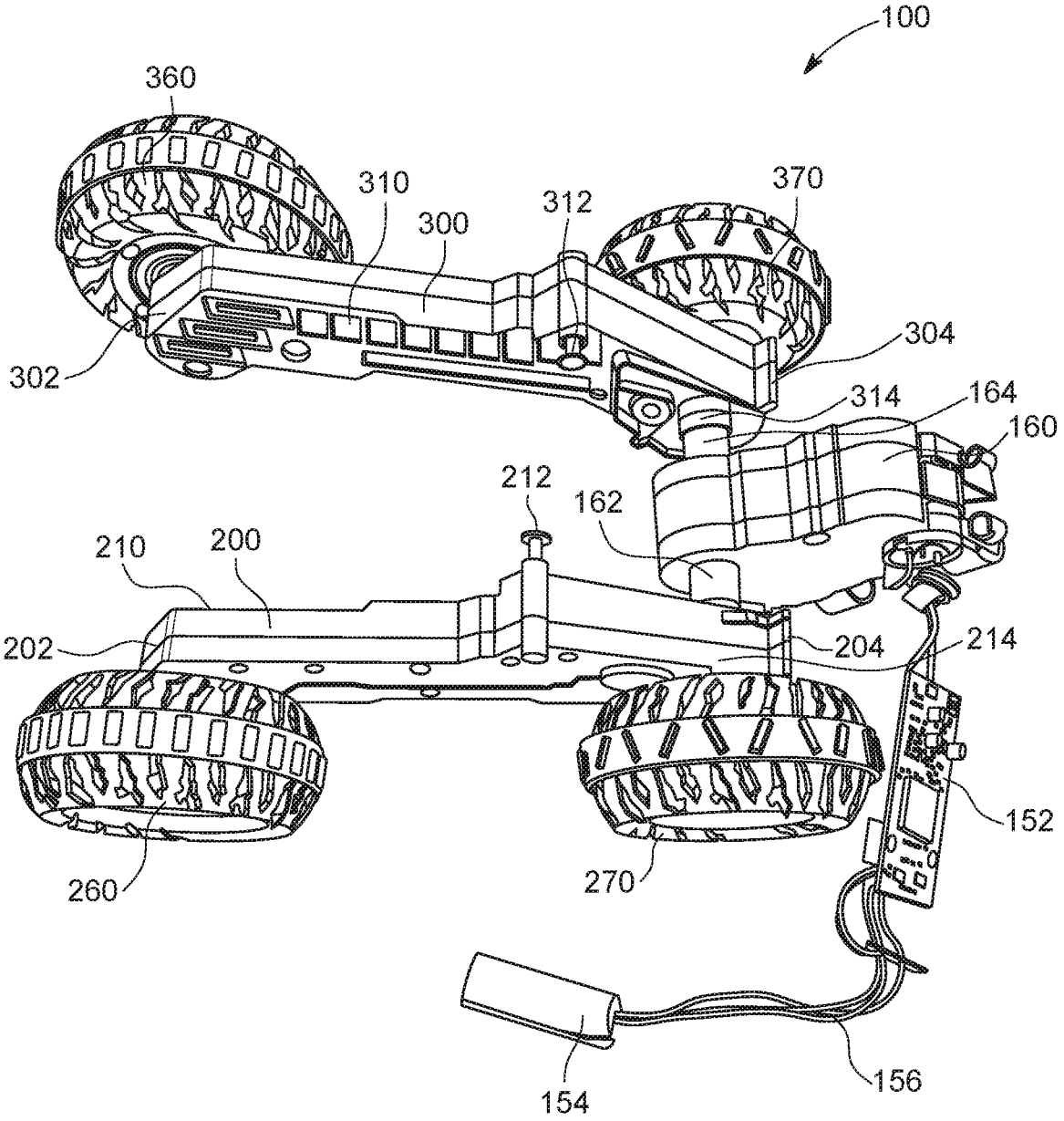
FIG. 13 is a top perspective view of the toy vehicle illustrated in FIG. 12 with the lower portion of its housing removed.

Referring to FIG. 13, the lower portion 114 of the toy vehicle body 110 has been removed. The housing 160 that contains the drive system components, including the two motors, is shown removed from the lower portion 114 of the toy vehicle body 110 and pivoted rearwardly. On opposite sides of the housing 160 are sleeves 162 and 164 that contain axles that are driven by the motors and that impart motion to the corresponding wheels and wheel supports. The axles in the sleeves 162 and 164 define the pivot points 214 and 314 for wheel supports 200 and 300, which are close to the rear ends 204 and 304 thereof. Front wheels 260 and 360 are rotatably mounted proximate to front ends 202 and 302 of wheel supports 200 and 300, respectively, and rear wheels 270 and 370 are rotatably mounted proximate to rear ends 204 and 304 of wheel supports 200 and 300, respectively. The pivot points 214 and 314 are proximate to the rear wheels 270 and 370, respectively, and the rear wheels 270 and 370 also rotate about the pivot points 214 and 314.

The wheel supports 200 and 300 include inner surfaces 210 and 310, respectively, Inner surface 210 has an inwardly directed projection 212 extending therefrom. Similarly, inner surface 310 has an inwardly directed projection 312 extending therefrom.

Figure 14:
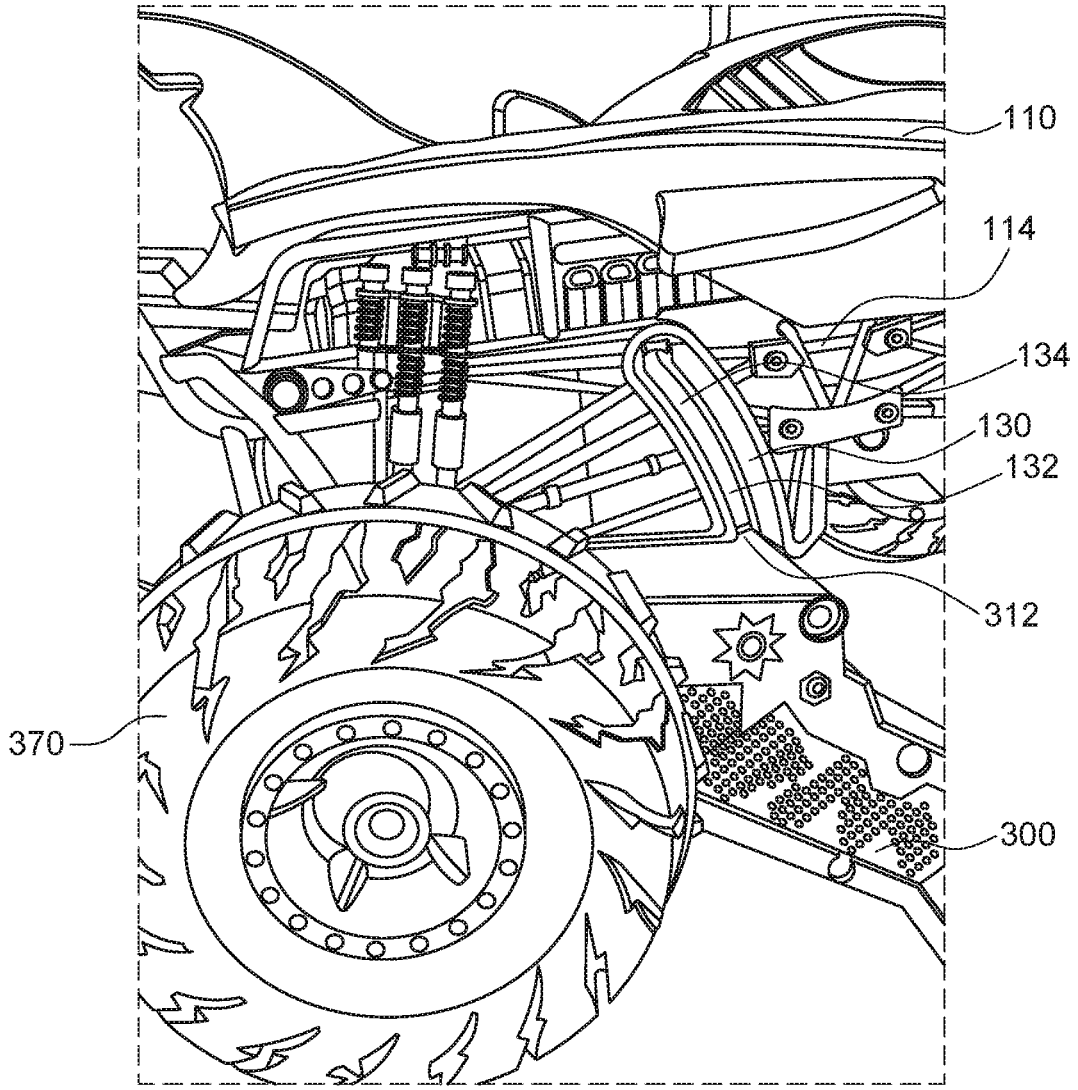
FIG. 14 is a close-up side view of the toy vehicle illustrated in FIG. 4 showing the limiter of the movement of a wheel support arm.
Figure 15:
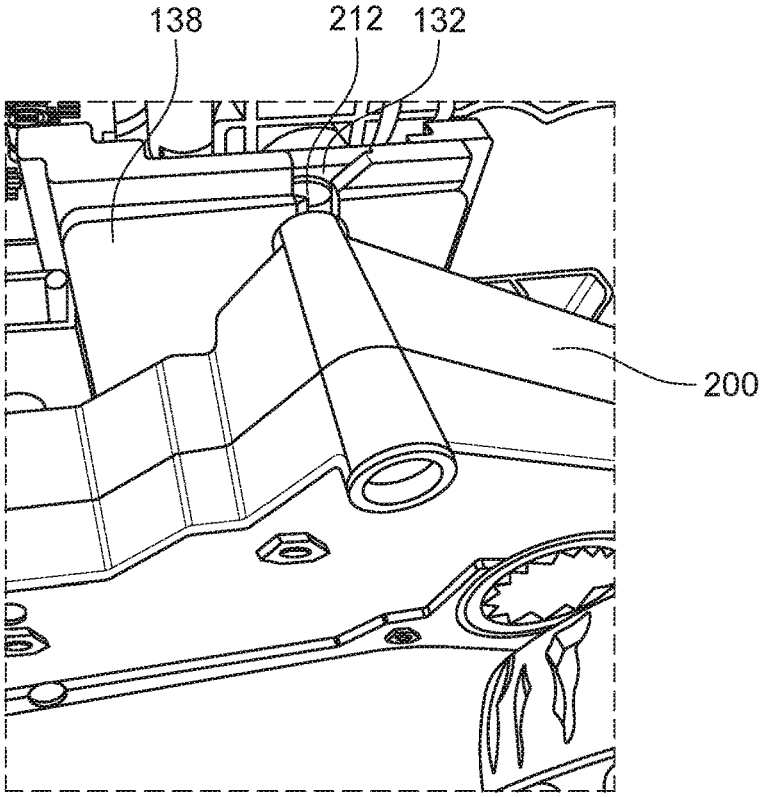
FIGS. 15 and 16 are close-up perspective views of certain components of the limiter illustrated in FIG. 14.
Figure 16:
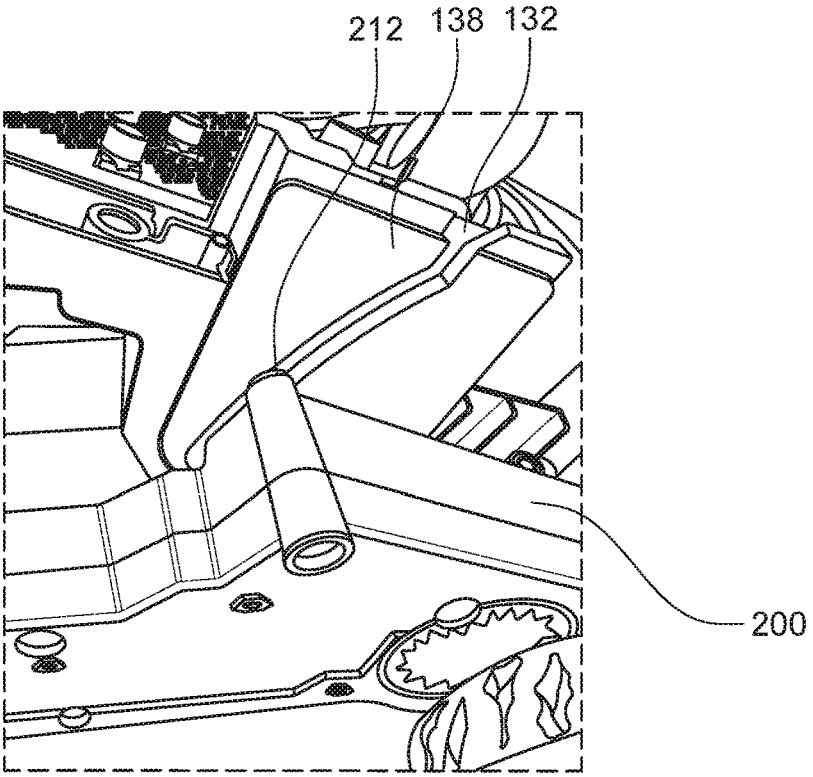

Turning to FIGS. 14-16, close-up views of different portions of toy vehicle 100 are illustrated. The upper portion 114 includes a ridged portion 130 that defines an arcuate slot 132 that has an upper end 134 and a lower end 136 (see FIG. 17). The projection 312 on wheel support 300 is inserted into slot 132 and can travel therealong. The length of the slot 132 limits the range of pivoting motion of wheel support 300 relative to toy vehicle body 110. The slot 132 operates as a limiter on the movement of wheel support 300.

In FIGS. 15 and 16, a plate 138 includes slot 132 formed therein. There are plates 138 on opposite sides of the toy vehicle 110 that are engaged by the wheel supports 200 and 300. In FIG. 15, the projection 212 on wheel support 200 is engaged with slot 132 and is shown at the upper end of the slot 132, which corresponds to the retracted position 206 of wheel support 200. In FIG. 16, the projection 212 is engaged with slot 132 and is shown at the lower end of the slot 132, which corresponds to the extended position 208 of wheel support 200.

Figure 17:
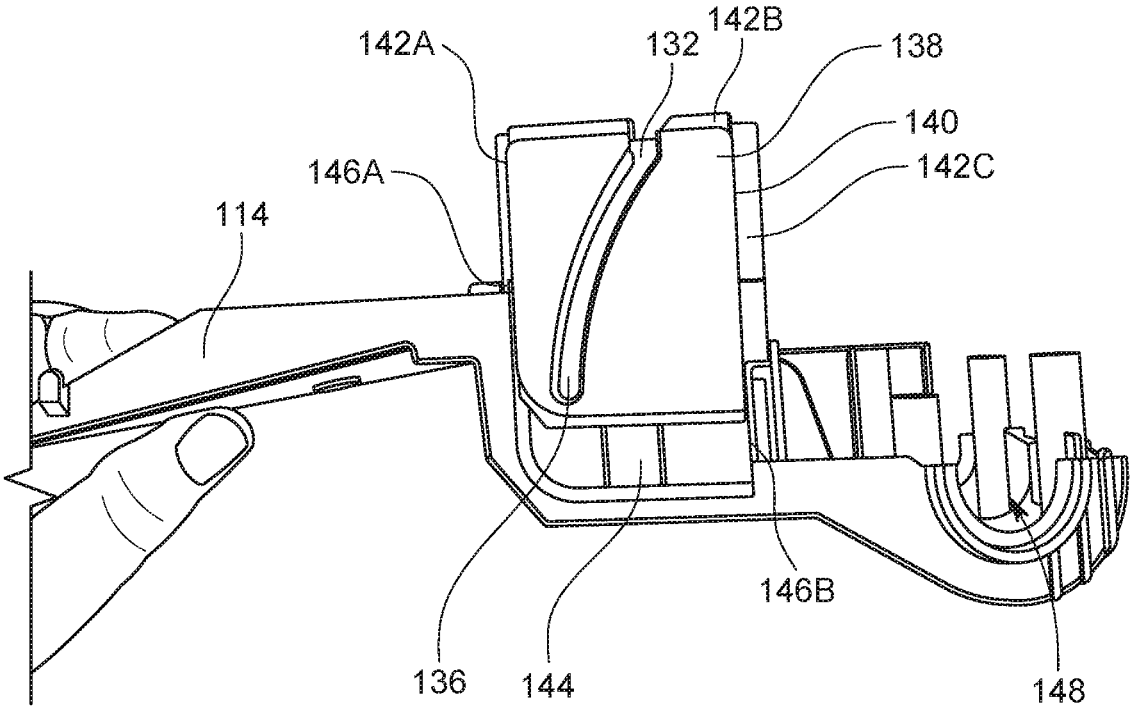
FIG. 17 is a side view of certain components of the limiter illustrated in FIGS. 15 and 16.

Referring to FIG. 17, a side view of some components of toy vehicle 100 is illustrated. The plate 138 that has slot 132 formed therein is removably mounted to the toy vehicle lower portion 114. The lower portion 114 has a pair of notches or recesses 144 formed in opposite sides. Each notch 144 is sized to receive a plate 138 therein. The lower portion 114 includes side rails 146A and 146B with grooves that slidably receive tabs 142A and 142C formed on opposite sides of plate 138. The tabs 142A and 142C, as well as tab 142B, extend outwardly from an outer edge 140 of the plate 138. Also shown in FIG. 17 are channels 148 that receive the sleeves 162 and 164 of the drive system 150, which are discussed above.

Figure 18:
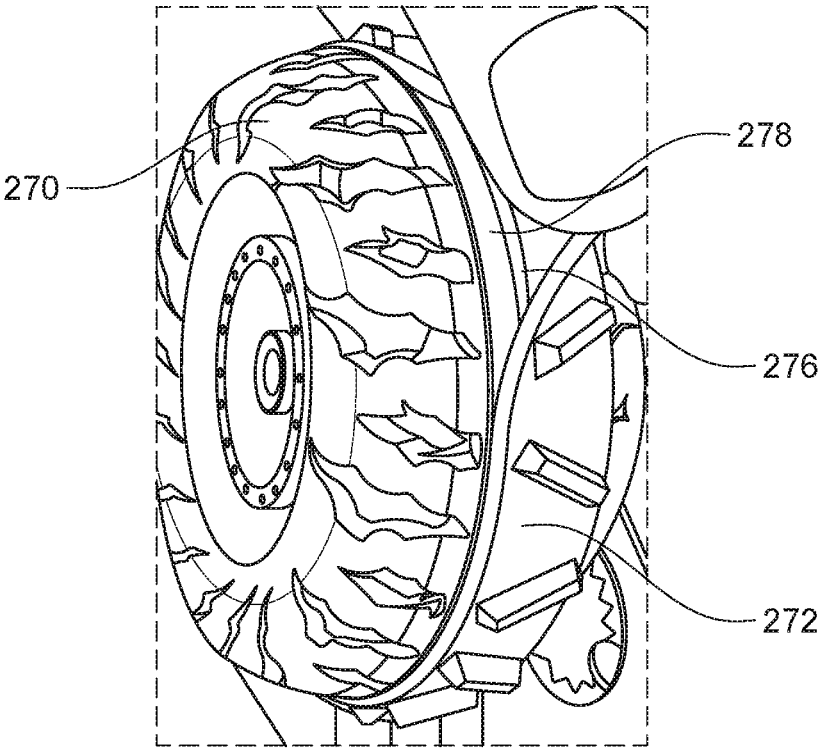
FIG. 18 is a perspective end view of a wheel of the toy vehicle illustrated in FIG. 4.
Figure 19:
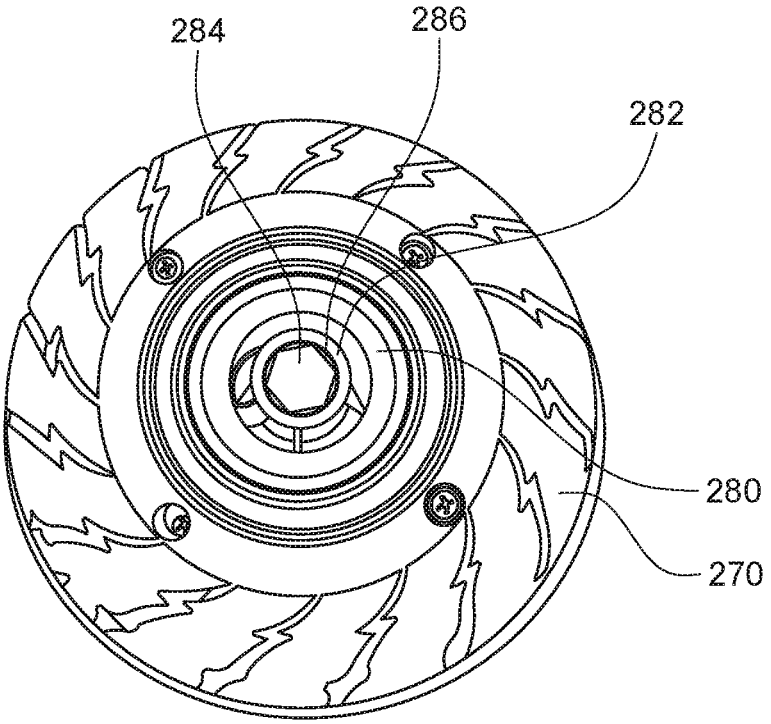
FIG. 19 is a side view of the wheel illustrated in FIG. 18.

Referring to FIGS. 18 and 19, an embodiment of a wheel for the toy vehicle 100 is illustrated. As shown in FIG. 18, rear wheel 270 includes a slot 278 in which a projecting portion 276 of tread member 272 is inserted to mount the tread member 272 to the body of the wheel 270. As shown in FIG. 19, the wheel 270 includes an inner surface 280 that has a central recess and a sleeve 282. Sleeve 282 defines an inner receptacle 284 that has several inner side surfaces 286. In this embodiment, the quantity of inner side surfaces 286 is six, but in different embodiments, the quantity of inner side surfaces may vary provided that the quantity matches the shape of the axle inserted in the sleeve 282.

Figure 20:
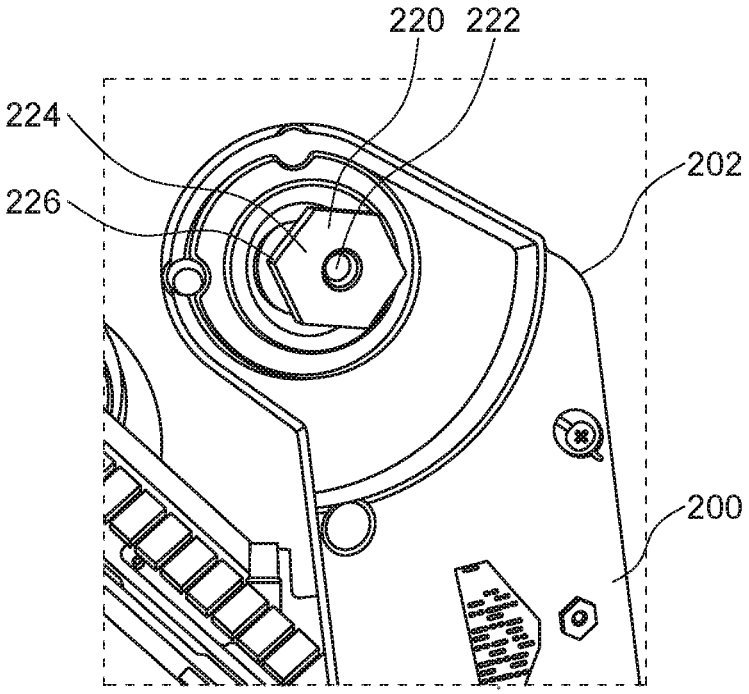
FIG. 20 is a side view of certain components of the toy vehicle illustrated in FIG. 4.
Figure 21:
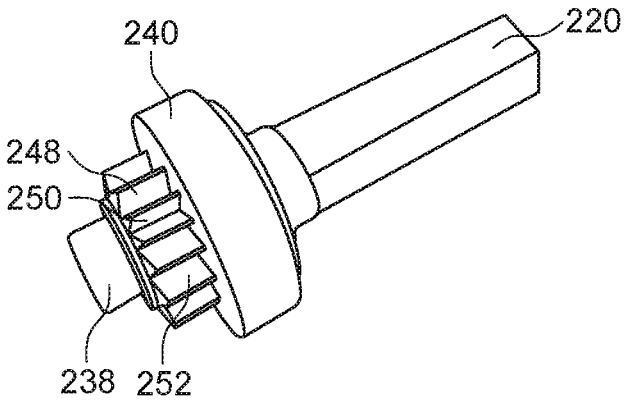
FIG. 21 is a perspective view of certain components related to the front axle of the toy vehicle illustrated in FIG. 4.
Figure 22:
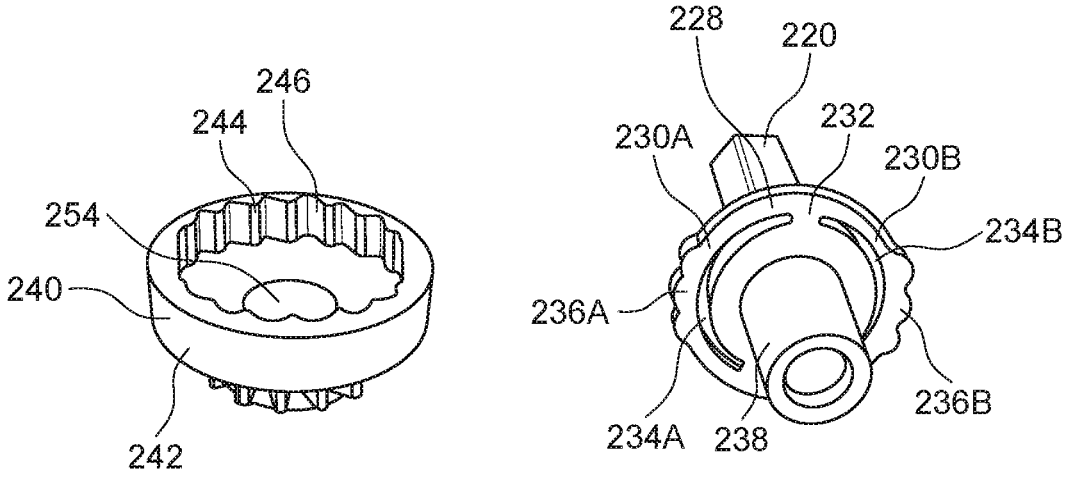
FIG. 22 is an exploded perspective view of certain components related to the front axle illustrated in FIG. 21.

Referring to FIG. 20-22, an embodiment of an axle for the toy vehicle according to the present invention is illustrated. The front end 202 of wheel support 200 has an axle 220 extending outwardly from its outer surface. The axle 220 includes a center portion or member 222 with a surrounding body portion 224 that has several outer sides or side surfaces 226. In this embodiment, the quantity of outer sides is six, which matches the quantity of inner sides surfaces of the sleeve on the wheel to be mounted to the axle 220.

The front axle of each wheel support 200 and wheel support 300 is driven by a set of gears that are engaged with that front axle and engaged with the corresponding rear axle of the particular wheel support 200 and 300. Thus, as the rear axle of a wheel support is rotated or driven, it engages one gear from a set of gears that extend along the inner cavity of the wheel support, and the rotation of the gears in the set is imparted to the corresponding front axle, causing it to rotate. It is to be understood that each of the front axle and rear axle for each of the wheel supports 200 and 300 are similarly structured, and that the sleeves formed on the inner surfaces of the wheels to be coupled to the wheel supports 200 and 300 are also similarly structured.

Turning to FIGS. 21-22, the front axle 220 includes several outer side surfaces at one end and a cylindrical distal portion 238 at its opposite end. Located therebetween is an engagement portion 228 that is formed of resilient portions 230A and 230B that are connected to the body of the axle 220 via oppositely located connectors 232 (only one of which is shown), thereby defining gaps 234A and 234B. On the outer surface of the resilient portions 230A and 230B are ridges or teeth 236A and 236B, respectively.

A drive member 240 is slidably mounted onto the axle 220 via a central opening 254 that receives the distal portion 238 of axle 220. The drive member 240 includes a body portion 242 that has an inner surface 244 defining teeth 246 thereal-long. The drive member 240 also includes a body portion 248 with a smaller outer diameter than body portion 242. Body portion 248 has an outer surface 250 that have teeth 252 as well.

In the toy vehicle 110, teeth 252 on outer surface 250 are engaged with the teeth of one of the gears that are located between the front axle and the rear axle in wheel support 200. As the rear axle is rotated, each of the gears in the set of gears between the front axle and the rear axle rotates, and the drive member 240 is rotated. Rotation imparted to the drive member 240 rotates the axle 220 because of the engagement of ridges 236A and 236B with teeth 246. It is to be understood that the discussion above as to the operation of the front axle 220 of wheel support 200 applies in a similar manner to the operation of the front axle of wheel support 300 as well.

In the illustrated embodiment, the drive assembly of the toy vehicle functions similar to a tank drive system. The toy vehicle drive assembly is configured such that varying the power applied to each of the rear wheels results in the toy vehicle performing a turning motion. By applying more power to one rear wheel versus the other rear wheel results in the toy vehicle turning in the direction of the lower power rear wheel.

The programming run by the CPU sets power percentages to achieve this tank drive style of turning of the toy vehicle. In one exemplary operation, applying 100% power to the left rear wheel in the forward direction while applying 18% power to the right rear wheel in the forward direction causes the toy vehicle to the right while driving forward without lifting either of the wheel supports or the front wheels. In other embodiments, the CPU can be programmed to control the motors using different power percentage levels. The percentages are tied to the gripping characteristics of the wheels and tire grips coupled to the wheels.

During operation of the toy vehicle, as the differential in the power applied to the rear wheels increases, the rate of turning of the toy vehicle also increases. In one embodiment, the rate of turning can be set to be proportional to the power differential applied to the rear wheels.

Another operation of the toy vehicle involves at least one of the motors operating in a reverse direction. In one exemplary implementation, when the left rear wheel is driven forward at 100% power and the right rear wheel is driven rearward at 100% power, the toy vehicle will make the most extreme turn possible, which is a 360° spin in place. In other implementations, the toy vehicle can make various turns based on applying power to the left rear wheel and to the right rear wheel in opposite directions.

The front ends 202 and 302 of the wheel supports 200 and 300 are independently forced downwards when the corresponding rear wheel coupled to the respective wheel support is driven in the reverse direction. The range of travel of the wheel support is limited by the travel of the projection on the wheel support in the corresponding slot of a limiter on the toy vehicle. When one of the wheel supports is driven downward, the other wheel support is raised or lifted in the air. This movement pushes up the toy vehicle body 110 until its travel is stopped. In one mode of operation, alternate wheel supports and front wheels will raise if the toy vehicle 100 is turning to the left or to the right at or above a set percentage rate.

The two motors of the toy vehicle 100 can alternate which is driven in reverse while the other motor is driven forward. When the reverse/forward alternating driving is done in short timing intervals, a stomping-like action of the toy vehicle 100 due to the movements of the wheels supports 200 and 300 is performed. In one mode of operation, the toy vehicle 100 can appear to walk in place when the front wheels and the wheel supports 200 and 300 are alternately lifted off a support surface. This alternating movement of the wheel supports 200 and 300 is performed when controller button 508 is pressed by a user.

In another mode of operation, the toy vehicle 100 can be driven into a vertical position. When the toy vehicle 100 is reversed at its maximum speed, the user can push the power stick 504 to full forward power. The result is that the toy vehicle 100 will rotate and the front wheels will be up in the air in a vertical orientation. In this mode, the toy vehicle 100 can spin 360° by running the two motors in opposing directions.

As discussed above, in one embodiment, the toy vehicle 100 has four driven wheels, which helps with the toy vehicle's driving ability on rough surfaces and climbing onto objects and obstacles. It is to be understood that the various modes of operation and actions described above are not limited to the four wheel drive functionality. All of the foregoing operating modes and actions can be achieved by a different embodiment of a toy vehicle in which only the rear wheels of the toy vehicle are driven.

While the toy vehicle presented herein, as well as portions thereof, have has been illustrated and described in detail and with reference to specific embodiments thereof, it is nevertheless not intended to be limited to the details shown. Instead, it will be apparent that various modifications and structural changes may be made therein without departing from the scope of the inventions and within the scope and range of equivalents of the claims. In addition, various features from one of the embodiments may be incorporated into another of the embodiments. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Accordingly, it is appropriate that the appended claims be construed broadly and in a manner consistent with the scope of the disclosure as set forth in the following claims.

It is also to be understood that the various components toy vehicle described herein may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Additionally, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

What is claimed is:

1. A toy vehicle, comprising:

a body including a drive system;

a first wheel support pivotally coupled to the body, the first wheel support being movable by the drive system between a first position and a second position relative to the body;

a first pair of wheels mounted to the first wheel support, the first pair of wheels including a first front wheel and a first rear wheel, the first wheel support and the first rear wheel being rotatable about a first pivot point;

a second wheel support pivotally coupled to the body, the second wheel support being movable by the drive system between a third position and a fourth position relative to the body; and a second pair of wheels mounted to the second wheel support, the second pair of wheels including a second front wheel and a second rear wheel, the second wheel support and the second rear wheel being rotatable about a second pivot point, wherein:

when the first wheel support is in its first position, the first wheel support extends along the body and each of the first front wheel and the first rear wheel is adjacent to the body, and when the first wheel support is in its second position, the first rear wheel is adjacent to the body and the first front wheel is in a lowered position spaced apart from the body, and wherein when the first wheel support is in its second position and the second wheel support is in its third position, the first front wheel, the first rear wheel, and the second rear wheel engage a support surface and the second front wheel is spaced apart from the support surface.

2. The toy vehicle of claim 1, wherein the first wheel support and the second wheel support are independently movable by the drive system.

3. The toy vehicle of claim 1, wherein when the second wheel support is in its third position, the second wheel support extends along the body.

4. The toy vehicle of claim 1, wherein when the first wheel support in its first position, the first wheel support extends parallel to the second wheel support when the second wheel support in its third position.

5. The toy vehicle of claim 1, wherein the first wheel support has a first longitudinal axis, the second wheel support has a second longitudinal axis, and the body has a third longitudinal axis, the first longitudinal axis being parallel to the third longitudinal axis when the first wheel support is in the first position, and the second longitudinal axis being parallel to the third longitudinal axis when the second wheel support is in the third position.

6. The toy vehicle of claim 5, wherein when the first wheel support is in the second position, the first longitudinal axis is not parallel to the third longitudinal axis, and when the second wheel support is in the fourth position, the second longitudinal axis is not parallel to the third longitudinal axis.

7. The toy vehicle of claim 1, wherein the body includes a first rear axle to which the first rear wheel is coupled, a first front axle to which the first front wheel is coupled, a second rear axle to which the second rear wheel is coupled, and a second front axle to which the second front wheel is coupled.

8. The toy vehicle of claim 7, wherein the drive system includes a first motor, a first gear, a second motor, and a second gear, the first motor drives the first gear to rotate the first rear axle, and the second motor drives the second gear to rotate the second rear axle.

9. The toy vehicle of claim 8, wherein the drive system includes a first set of gears that are operably coupled to the first rear axle and to the first front axle, and when the first motor drives the first gear to rotate the first rear axle, the first rear axle drives the first set of gears to rotate the first front axle.

10. The toy vehicle of claim 9, wherein the drive system includes a second set of gears that are operably coupled to the second rear axle and to the second front axle, and when the second motor drives the second gear to rotate the second rear axle, the second rear axle drives the second set of gears to rotate the second front axle.

11. The toy vehicle of claim 10, wherein the first motor and the second motor operate independently of each other.

12. A toy vehicle, comprising:

a body having front end and a rear end opposite the front end, the body having a first side portion and a second side portion opposite the first side portion;

a first wheel support coupled to the body, the first wheel support being drivable between a first position in which the first wheel support extends along the first side portion and a second position in which the first wheel support extends away from the body, the first wheel support including a first front wheel and a first rear wheel coupled thereto, each of the first rear wheel and the first wheel support being rotatable about a first pivot point; and a second wheel support coupled to the body, the second wheel support being drivable between a third position in which the second wheel support extends along the second side portion and a fourth position in which the second wheel support extends away from the body, the second wheel support including a second front wheel and a second rear wheel coupled thereto, wherein when the first wheel support is in its second position and the second wheel support is in its third position, the first front wheel engages a support surface and the second front wheel is spaced apart from the support surface.

13. The toy vehicle of claim 12, wherein the body includes a drive system that can be actuated to move the first wheel support relative to the body and the second wheel support relative to the body.

14. The toy vehicle of claim 12, wherein the first wheel support and the second wheel support are parallel to each other when the first wheel support is in its first position and the second wheel support is in its third position.

15. The toy vehicle of claim 14, wherein the first wheel support and the second wheel support are not parallel to each other when the first wheel support is in its second position and the second wheel support is in its third position.

16. The toy vehicle of claim 11, wherein each of the first rear wheel and the second rear wheel engages a support surface when the first wheel support is in either of its first position or its second position, and when the second wheel support is in either of its third position or its fourth position.

17. The toy vehicle of claim 12, wherein each of the first wheel support and the second wheel support has a longitudinal axis, the longitudinal axes of the first wheel support and the second wheel support being parallel to each other when the first wheel support is in the first position and the second wheel support is in the third position, and the longitudinal axes of the first wheel support and the second wheel support are not parallel to each other when first wheel support is in the second position and the second wheel support is in the fourth position.

18. A method of moving a toy vehicle, the toy vehicle including a body, a drive system, a first wheel support pivotally coupled to the body and movable by the drive system between a first position and a second position relative to the body, the first wheel support having a first front wheel and a first rear wheel coupled thereto, the first wheel support and the first rear wheel being rotatable about a first pivot point, a second wheel support pivotally coupled to the body, the second wheel support being movable by the drive system between a third position and a fourth position relative to the body, the second wheel support having a second front wheel and a second rear wheel coupled thereto, the second wheel support and second rear wheel being rotatable about a second pivot point, the method comprising the steps of:

driving the first wheel support from its first position to its second position in which the first wheel support extends downwardly from the body and the second wheel support remains in its third position with the second front wheel spaced apart from a support surface;

moving the toy vehicle along the support surface;

driving the first wheel support about the first pivot point from its second position to its first position in which the first wheel support extends along a side of the body;

driving the second wheel support about the second pivot point from its third position to its fourth position in which the second wheel support extends downwardly from the body; and moving the toy vehicle along the support surface.

19. The method of claim 18, wherein the step of driving the first wheel support from its first position to its second position includes pivoting the first wheel support relative to the body.

20. The method of claim 18, wherein the step of driving the first wheel support from its first position to its second position includes actuating the drive system to move the first wheel support relative to the body.

* * * * *